US012152594B2

(12) United States Patent
Park et al.

(10) Patent No.: US 12,152,594 B2
(45) Date of Patent: Nov. 26, 2024

(54) AIR CIRCULATOR AND AIR CLEANER INCLUDING AIR CIRCULATOR

(71) Applicant: LG Electronics Inc., Seoul (KR)

(72) Inventors: Joonmin Park, Seoul (KR); Taeman Yang, Seoul (KR); Choonmyun Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/371,706

(22) Filed: Jul. 9, 2021

(65) Prior Publication Data

US 2022/0010799 A1 Jan. 13, 2022

(30) Foreign Application Priority Data

Jul. 10, 2020 (KR) ..... 10-2020-0085477

(51) Int. Cl.
*F04D 19/00* (2006.01)
*F04D 25/06* (2006.01)
*F04D 29/70* (2006.01)

(52) U.S. Cl.
CPC ..... *F04D 19/002* (2013.01); *F04D 25/06* (2013.01); *F04D 29/703* (2013.01)

(58) Field of Classification Search
CPC ..... F04D 25/06; F04D 25/08; F04D 25/082; F04D 29/5806; F04D 29/703; F04D 19/002; F04D 19/007; F04D 25/16; F04D 25/166; F04D 25/10; F04D 27/002; F24F 2221/28
See application file for complete search history.

(56) References Cited

U.S. PATENT DOCUMENTS 7,059,826 B2 * 6/2006 Lasko ..... F04D 25/166 416/126
2003/0026600 A1 * 2/2003 Delonghi ..... F04D 25/10 392/367

(Continued)

FOREIGN PATENT DOCUMENTS

CN 205316611 6/2016
CN 106705211 5/2017

(Continued)

OTHER PUBLICATIONS

Extended European Search Report in European Appln. No. 21184808.0, dated Dec. 10, 2021, 8 pages.

(Continued)

*Primary Examiner* — Alexander B Comley
(74) *Attorney, Agent, or Firm* — Fish & Richardson P.C.

(57) ABSTRACT

An air circulator includes a housing having a first inlet and a first outlet, an oblique-flow fan disposed in the housing, and a motor rotating the oblique-flow fan. An outer wall of the housing includes a first outer wall extending in a front-rear direction and a second outer wall having the first inlet and extending from an edge of the first inlet towards the first outer wall to be enlarged in a radially outward direction. An outer surface of the second outer wall comprises a first surface that extends towards the first outer wall to be rounded outwards, and forms a surface continuous with an outer surface of the first outer wall, thus guiding air flowing along an outside of the first inlet so that the air flows forwards along the outer surface of the first outer wall.

26 Claims, 16 Drawing Sheets

(56) References Cited

U.S. PATENT DOCUMENTS

| | | | | |
|---|---|---|---|---|
| 2005/0123392 | A1* | 6/2005 | Belsito | F04D 17/04 415/53.1 |
| 2010/0111667 | A1* | 5/2010 | Stagg | F04D 29/441 415/191 |
| 2017/0246572 | A1* | 8/2017 | Park | F24F 8/80 |
| 2017/0246581 | A1* | 8/2017 | Jung | F24F 8/10 |
| 2018/0335228 | A1 | 11/2018 | Brown et al. | |
| 2019/0264948 | A1* | 8/2019 | Jung | A61L 2/22 |
| 2019/0331137 | A1* | 10/2019 | Xiao | F04D 29/325 |
| 2020/0129909 | A1* | 4/2020 | Hong | F04D 25/166 |
| 2020/0158357 | A1 | 5/2020 | Son et al. | |

FOREIGN PATENT DOCUMENTS

| | | | | | |
|---|---|---|---|---|---|
| CN | 106917777 | A * | 7/2017 | | F04D 25/08 |
| CN | 106989448 | | 7/2017 | | |
| CN | 106989448 | A * | 7/2017 | | A61L 9/22 |
| CN | 209228655 | | 8/2019 | | |
| CN | 209857261 | | 12/2019 | | |
| DE | 202018106504 | U1 * | 2/2019 | | F04D 17/06 |
| EP | 1715191 | A1 * | 10/2006 | | F04D 25/08 |
| EP | 3045733 | | 7/2016 | | |
| EP | 3045733 | A1 * | 7/2016 | | F04D 25/0666 |
| EP | 3425207 | | 1/2019 | | |
| EP | 3425207 | A1 * | 1/2019 | | F04D 17/10 |
| KR | 10-1623692 | | 5/2016 | | |
| KR | 20170048243 | A * | 5/2017 | | F04D 25/08 |
| WO | WO2010021712 | | 2/2010 | | |
| WO | WO-2018235221 | A1 * | 12/2018 | | F04D 17/06 |
| WO | WO-2019026269 | A1 * | 2/2019 | | A47K 10/48 |
| WO | WO-2019194637 | A1 * | 10/2019 | | F04D 29/281 |

OTHER PUBLICATIONS

Office Action in Chinese Appln. No. 202110784426.0, dated Aug. 25, 2022, 21 pages (with English translation).

* cited by examiner

B, 55°

A, 55°

B, 70°
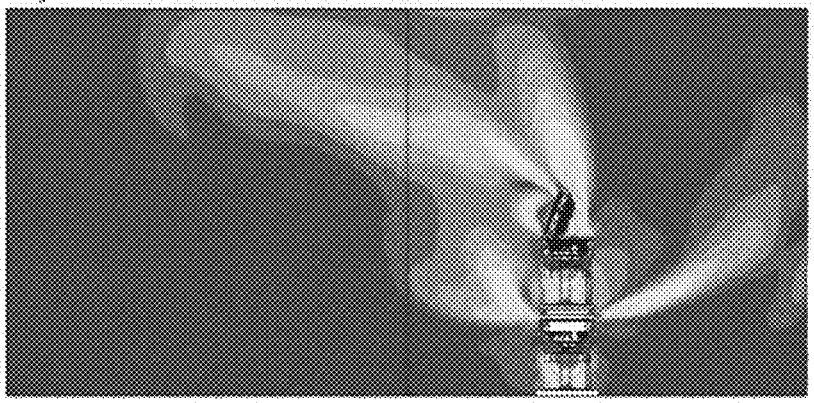
FIG. 15A
A, 70°
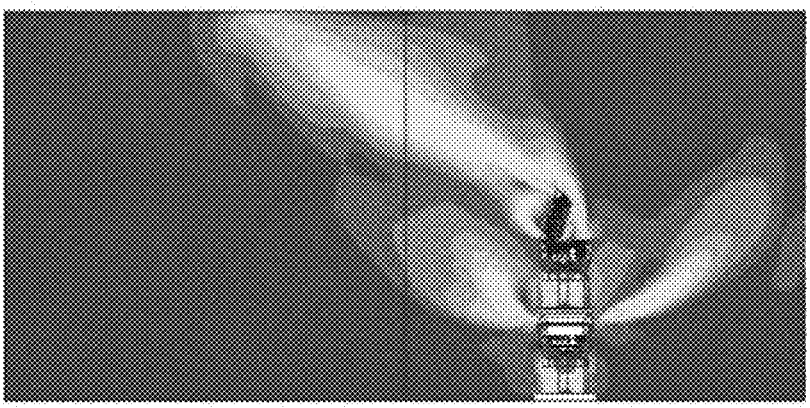
FIG. 15B
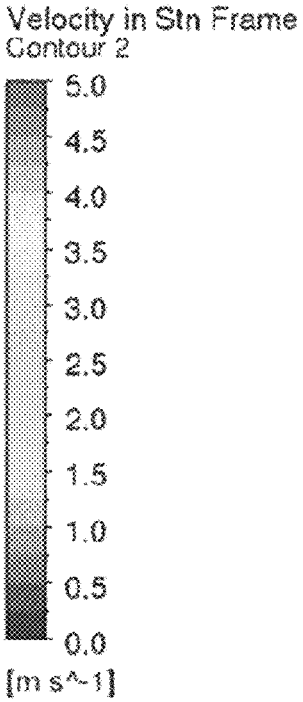

B, 90°
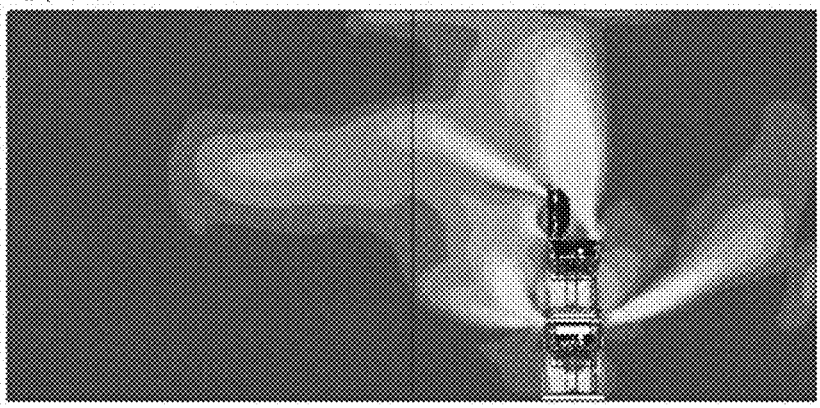
FIG. 16A
A, 90°
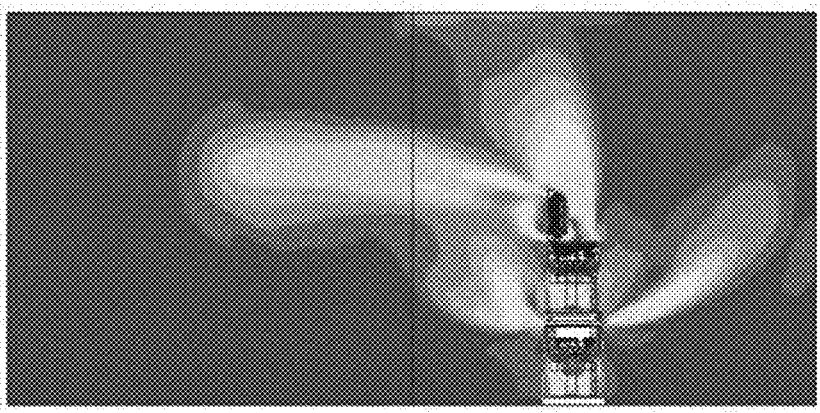
FIG. 16B
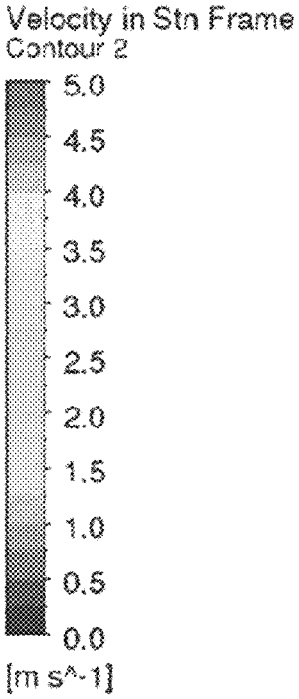

AIR CIRCULATOR AND AIR CLEANER INCLUDING AIR CIRCULATOR

CROSS-REFERENCE TO RELATED APPLICATION

This application claims priority to and the benefit of Korean Patent Application No. 10-2020-0085477, filed on Jul. 10, 2020, the disclosure of which is incorporated herein by reference in its entirety.

BACKGROUND OF THE DISCLOSURE

Field of the Disclosure

The present disclosure relates to an air circulator and an air cleaner including the air circulator and, more particularly, to an air circulator and an air cleaner including the air circulator, capable of improving the directivity of discharged airflow.

Related Art

Generally, an air circulator is a device that circulates air to create a pleasant environment. The air circulator generates the flow of air through a motor and a fan and then discharges the air in a predetermined direction.

The air circulator sends straight wind to a distant place to make air in a room uniform. The performance of discharging indoor air in a predetermined direction is one of important factors of the air circulator.

The air circulator is used together with an airflow discharging device, such as an air conditioner or an air cleaner, to circulate cold air or warm air in a room or to circulate purified air in a room.

Meanwhile, in the air circulator, a fan is rotated to suction air through an intake path, and the suctioned air is discharged through the air circulator to an outside. In this connection, Korean Patent Laid-Open Publication No. 10-1878629 has disclosed an air circulator that suctions and discharges outside air by rotating the fan.

However, in the related art, if the air circulator suctions air through an inlet, the pressure of air in the intake path increases, so some air may not pass through the inlet. This air leaks to the outside while having directivity. Since the leaked air is dispersed without being discharged in a predetermined airflow direction, the flow energy of the air may be lost.

Meanwhile, Korean Patent No. 10-2026194 has disclosed an air cleaner including a blowing device that causes air to flow from a circumferential surface of a lower side to an upper side, and a flow change device (air circulator) that suctions air discharged from the blowing device to freely change the flow.

However, some of clean air discharged from the blowing device may leak to the outside without being suctioned into an intake grill that is formed on a rear portion of the flow change device, so the clean air may not be discharged in a predetermined airflow direction.

DOCUMENTS OF RELATED ART

Patent Document

KR 10-2026194 (Nov. 4, 2019)
KR 10-1878629 (Jul. 16, 2018)
KR 10-2017-0067342 (Jun. 16, 2017)
KR 10-1474181 (Dec. 17, 2014)

SUMMARY

The present disclosure is to solve the above-described problems.

When an air circulator is driven, some air has directivity to be suctioned to the air circulator, and may leak to the outside without being suctioned into the air circulator while the air flowing. The present disclosure is to guide air, which flows along an outside of the air circulator without passing through the air circulator, in a predetermined direction.

The present disclosure is to minimize the loss of the flow quantity of air passing through an air circulator, even if an intake-path area of the air circulator is reduced.

The present disclosure is to provide an air cleaner including an air circulator that suctions air discharged from a blowing device and then discharges the air in a predetermined direction.

While clean air filtered and discharged from a blowing device is suctioned into an air circulator and then is discharged in a predetermined direction, some of the clean air may leak to an outside without being suctioned into the air circulator. The present disclosure is to guide the clean air flowing along the outside of the air circulator in a predetermined direction, thus minimizing the loss of the flow quantity of the clean air discharged from the blowing device.

Technical objects to be achieved by the present disclosure are not limited to the aforementioned technical objects, and other technical objects not described above may be evidently understood by a person having ordinary skill in the art to which the present disclosure pertains from the following description.

In order to accomplish the above objects, an air circulator according to an embodiment of the present disclosure may include a housing having a first inlet and a first outlet formed thereof and including an outer wall, a circulation fan disposed in the housing to suction air through the first inlet and then discharge the air through the first outlet to a front of the housing, and a motor rotating the circulation fan. An outer wall of the housing may include a first outer wall extending in a front-rear direction, the first outlet being formed on a front portion thereof.

In order to accomplish the above objects, the air circulator may further include a second outer wall having the first inlet formed in a rear portion thereof and extending from an edge of the first inlet towards the first outer wall to be enlarged in a radially outward direction. An outer surface of the second outer wall may include a first surface that extends towards the first outer wall to be rounded outwards and forms a surface continuous with an outer surface of the first outer wall. Thus, air flowing along an outside of the first inlet is guided to the outer surface of the first outer wall while flow is smoothly changed along the curvature of a curved surface formed by the first surface of the second outer wall, and the air is guided to flow along the outer surface of the first outer wall in a predetermined airflow direction. Therefore, a loss of flow energy for air that is not introduced into the first inlet may be minimized.

Further, in order to minimize a loss of air volume even if an intake path area of the first inlet is reduced due to the shape of the second outer wall, the circulation fan may be formed of an oblique-flow fan that discharges air to the front of the housing.

The first outer wall may extend in the shape of a band in a circumferential direction about a central axis to have a cylindrical shape, so it is possible to guide air flowing along the outer surface of the first outer wall in a predetermined direction where the air circulator is intended to discharge air.

Since the outer surface of the first outer wall is formed to be parallel to a rotating shaft of the oblique-flow fan in the front-rear direction, it is possible to secure a wide discharge path area of the air circulator and simultaneously to increase straightness such that air flowing along the outer surface of the first outer wall is directed in a predetermined direction.

The outer surface of the first outer wall and the outer surface of the second outer wall may form a continuous surface in a circumferential direction to be shielded from outside, thus inducing Coanda effect while air is not introduced through the first and second outer walls into the air circulator.

The first surface may be formed to be rounded at a connecting portion between the outer surface of the first outer wall and the outer surface of the second outer wall.

The outer surface of the second outer wall may include a second surface that extends from the edge of the first inlet towards the first surface so that a slope of a longitudinal section is constant, thus allowing air to be guided to the first surface while minimizing a change in the flow path of air flowing along the outside of the first inlet.

The first outer wall and the second outer wall may be detachably coupled to each other. Therefore, since the first outer wall may be detached from the second outer wall, the internal components of the air circulator may be easily managed.

The air circulator may further include a motor base that is disposed in a center of the rear portion of the second outer wall to be spaced apart from the second outer wall and form the first inlet between the motor base and the second outer wall, and is disposed in back of the motor to support the motor.

The air circulator may further include an outer grill including a plurality of partition walls that are spaced apart from each other to form a plurality of vent holes therebetween, and disposed in the first inlet.

Further, the second outer wall may extend from an edge of the outer grill towards the first outer wall to be gradually enlarged in a radially outward direction, and the plurality of partition walls may include a plurality of outer partition walls disposed adjacent to the edge of the outer grill and formed such that ends thereof are inclined towards the outer surface of the second outer wall. Thus, it is possible to guide air, which flows along an outside of the outer grill without passing through the outer grill 20, along an end surface of the outer grill to the second outer wall.

The plurality of outer partition walls may be rounded such that the ends thereof form a continuous inclined surface with the outer surface of the second outer wall. Thus, when an imaginary line passing through the outer surface of the second outer wall and the end surface of the outer partition wall is extended, the imaginary line forms a continuous gentle curve, so flow resistance may be minimized when air flows along the end surface of the outer grill to be guided to the second outer wall.

The plurality of outer partition walls may include a plurality of inner partition walls that are disposed inside the outer partition walls and formed such that ends thereof are positioned on a flat surface. Thus, it is possible to prevent the volume of the outer grill from being unnecessarily increased to the rear portion of the air circulator.

The oblique-flow fan may include a hub disposed in front of the motor and connected at a center to an output shaft of the motor, a shroud disposed in back of the hub to be spaced apart therefrom and having an inlet formed in a central portion thereof to suction air, and a plurality of blades disposed between the hub and the shroud, thus allowing airflow to be circulated while minimizing the loss of air volume even if an intake path area and/or a discharge path area is reduced.

The hub and the shroud may extend towards the front to be gradually enlarged in the radially outward direction, and face the second outer wall. Therefore, air flowing along the outer surface of the second outer wall may be guided to the outer surface of the first outer wall, and simultaneously an area between the hub and the shroud may be maximized, thus maximizing the flow quantity of the air that passes between the hub and the shroud.

Each of the blades may extend from the shroud to the hub to be inclined forwards, so air discharged through the blade may flow in a forwardly inclined direction and an area contacting with the blade may be increased to the maximum.

A diameter of the first inlet may be formed to be larger than a diameter of an inner circumferential end of the shroud and smaller than a diameter of an outer circumferential end of the shroud.

The air circulator of the present disclosure may further include a guide vane device installed along a circumference of the first outer wall between the first outer wall and the oblique-flow fan and guiding the discharge of air to the front of the housing, so it is possible to guide air, discharged in the forwardly inclined direction of the housing by the oblique-flow fan, to the front of the housing.

An air cleaner according to an embodiment of the present disclosure may include the air circulator.

An air cleaner according to another embodiment of the present disclosure may further include a blowing device including a blowing fan generating air flow and a second outlet through which air passing through the blowing fan is discharged, the air circulator may be movably disposed on a side of the blowing device, and the second outer wall may guide air, discharged from the second outlet and flowing along an outside of the first inlet, along an outer surface of the first outer wall to a front of the air circulator. Thus, it is possible to prevent a problem where clean air discharged from the blowing device leaks to the outside of the first inlet and thereby an air volume is reduced, and to maximize the amount of clean air that flows in a predetermined direction.

A diameter of the first inlet may be smaller than a diameter of the second outlet, so the second outer wall faces at least a portion of the second outlet. Thus, some of the clean air discharged from the second outlet may be suctioned through the first inlet into the air circulator and then be discharged, and clean air that is not suctioned into the first inlet and flows along the outside of the first inlet may be guided along the outer surface of the second outer wall to the outer surface of the first outer wall.

The second outlet may be formed on an upper surface of the blowing device in a circumferential direction, and the air circulator may be disposed on an upper side of the second outlet such that the second outer wall may face the second outlet. Here, the second outlet and the second outer wall extending in a radially outward direction may face each other in a circumferential direction, so air discharged upwards from the second outlet may come into contact with all surfaces of the second outer wall in the circumferential direction.

If the air circulator is positioned at a first position where it lies down, the first outer wall may be disposed to extend long in a direction where air is discharged from the second outlet, and the second outer wall may be disposed above the second outlet to be spaced apart therefrom and may obliquely face the second outlet. Therefore, since clean air discharged by the blowing device in one direction is discharged along an inclined surface formed by the second outer wall in the radially outward direction of the air circulator, the clean air may be uniformly discharged in a 360-degree direction.

If the air circulator is positioned at a second position where it is erected, the first outer wall may be disposed to extend long in a predetermined airflow direction, and at least a portion of the second outer wall may be disposed towards the first outer wall to be gradually enlarged in a direction where the second outlet discharges air. Therefore, the air circulator may suction clean air discharged in one direction from the blowing device and then guide the clean air in a predetermined airflow direction, and clean air that is not suctioned through the first inlet of the air circulator may be guided along the inclined surface formed by the second outer wall to the outer surface of the first outer wall and then be guided in the predetermined airflow direction.

Other specific details of the present disclosure are included in the detailed description and drawings.

Advantageous Effects

An air circulator and an air cleaner including an air circulator according to the present disclosure have the following effects.

First, it is advantageous in that the shape of an outer wall and an outer grill of a housing allows air flowing along an outside of the air circulator without passing through the air circulator to be guided in a predetermined direction.

Second, it is advantageous in that the loss of the flow quantity of air passing through the air circulator can be minimized in spite of the shape of the outer wall, by using an oblique-flow fan.

Third, the present disclosure provides an air cleaner including an air circulator that suctions air discharged from a blowing device and then discharges the air in a predetermined direction, thus enabling purified air to be guided in the predetermined direction.

Fourth, it is advantageous in that air discharged from a blowing device and flowing to an outside of an air circulator is guided in a predetermined direction through the shape and arrangement of an outer wall of the air circulator.

Effects of the present disclosure are not limited to the aforementioned effects, and other effects not described above may be evidently understood by a person having ordinary skill in the art to which the present disclosure pertains from the claims.

BRIEF DESCRIPTION OF THE DRAWINGS

FIGS. 14A to 16B are diagrams showing the results of simulating the air flow of the air cleaner 1 according to an embodiment of the present disclosure and an air cleaner according to another embodiment through computational fluid dynamics (CFD).

DESCRIPTION OF EXEMPLARY EMBODIMENTS

Figure 1:
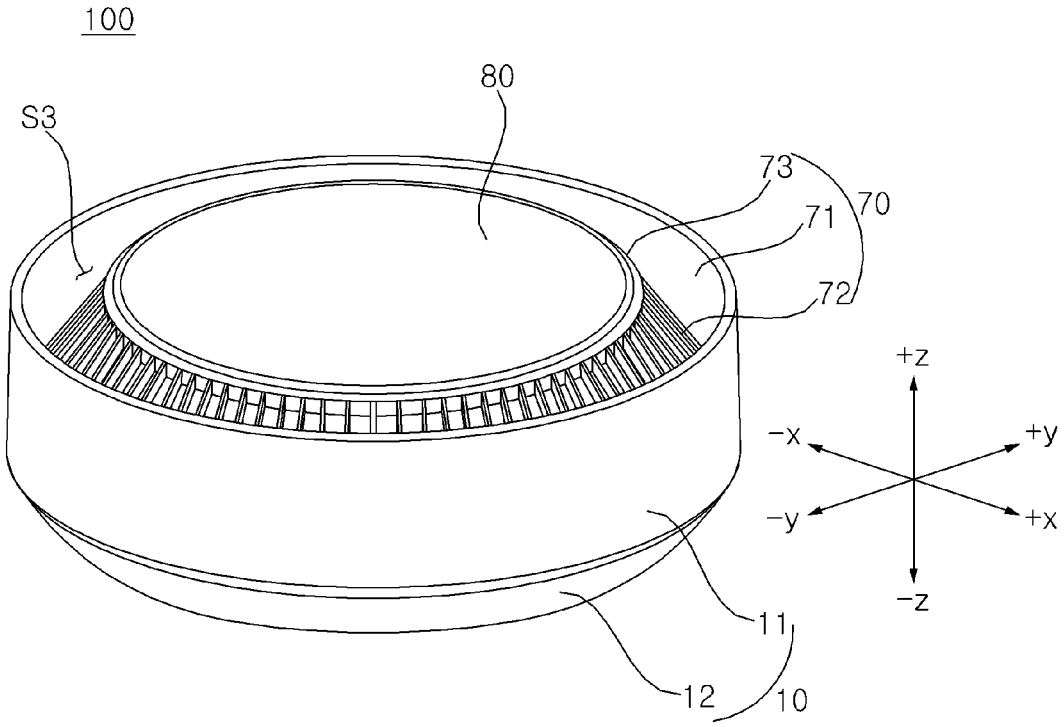
FIG. 1 is a perspective view showing an air circulator 100 according to an embodiment of the present disclosure.

The above and other objectives, features, and other advantages of the present disclosure will be more clearly understood from the following detailed description when taken in conjunction with the accompanying drawings. However, the disclosure may be embodied in different forms without being limited to the embodiments set forth herein. Rather, the embodiments disclosed herein are provided to make the disclosure thorough and complete and to sufficiently convey the spirit of the present disclosure to those skilled in the art. The present disclosure is to be defined by the claims. Like reference numerals refer to like parts throughout various figures and embodiments of the present disclosure.

Spatially relative terms, such as "below", "beneath", "lower", "above", or "upper", may be used to easily describe a correlation between one component and another component shown in the drawing. It should be understood that the spatially relative terms cover different directions of components when in use or in operation, in addition to the direction shown in the drawings. For example, when a component shown in the drawing is turned over, a component described as being "below" or "beneath" another component may be placed "above" the latter component. Thus, the exemplary term "below" may include both the terms "below" and "above". The component may also be oriented in a different direction, and thus spatially relative terms may be interpreted according to an orientation.

The terminology used herein is for the purpose of describing particular embodiments only and is not intended to be limiting. In the specification, the singular forms are intended to include the plural forms as well, unless the context clearly indicates otherwise. It will be further understood that the terms "comprise", "include", "have", etc. when used in this specification do not preclude the presence or addition of one or more other features, integers, steps, operations, elements, components, and/or combinations thereof.

Unless otherwise defined, all terms (including technical and scientific terms) used herein may be used as the common meaning understood by those skilled in the art. Further, terms defined in a commonly used dictionary are not to be interpreted in an idealized or overly formal sense unless expressly so defined herein.

The thickness or size of components shown in the drawings may be exaggerated or omitted for the clarity and convenience of description. Further, the size and area of each component do not completely reflect the actual size or area.

Hereinafter, a preferred embodiment of the present disclosure will be described with reference to the accompanying drawings.

Hereinafter, an air circulator 100 and an air cleaner 1 including the air circulator 100 according to embodiments of the present disclosure will be described with reference to the accompanying drawings.

[Air Circulator 100]

Hereinafter, the direction of the air circulator 100 is defined.

Based on an orthogonal coordinate system shown in FIGS. 1 to 10, a z axis direction may be defined as a front-rear direction of the air circulator 100. Here, a direction in which a +z axis is directed may be defined as a front direction, and a direction in which a −z axis is directed may be defined as a rear direction. Since air flows from the −z axis direction through the air circulator 100 to the +z axis direction, a side where air is suctioned into the air circulator 100 may be referred to as a rear side, and a side where air is discharged from the air circulator 100 may be referred to as a front side, based on the z axis.

Further, since the rotating axis of each of a circulation fan 30 and a motor 40 of the air circulator 100 is formed parallel to the z axis, a direction in which the z axis is directed may be defined as an axial direction of the air circulator 100. Furthermore, a rotating direction about the axial direction may be defined as a circumferential direction. The rotating axis of each of the circulation fan 30 and the motor 40 may be referred to as the central axis of the air circulator 100.

Further, a direction in which a xy plane perpendicular to the z axis is formed may be defined as a radial direction of the air circulator 100. In other words, it is to be understood that the radial direction is perpendicular to the axial direction. Furthermore, in the radial direction, a direction extending vertically from the center of the z axis towards an outside may be defined as a radially outward direction, and a direction extending vertically from the outside towards the center of the z axis may be defined as a radially inward direction.

Figure 2:
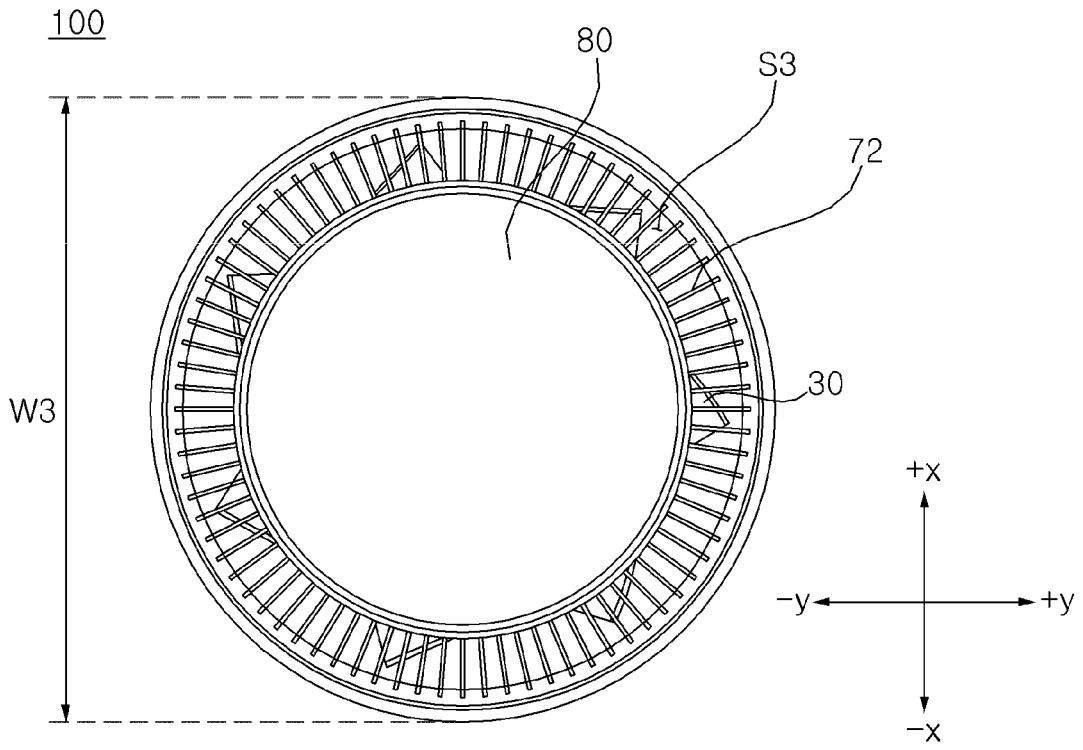
FIG. 2 is a plan view of the air circulator 100 of FIG. 1 when seen from a front.
Figure 3:
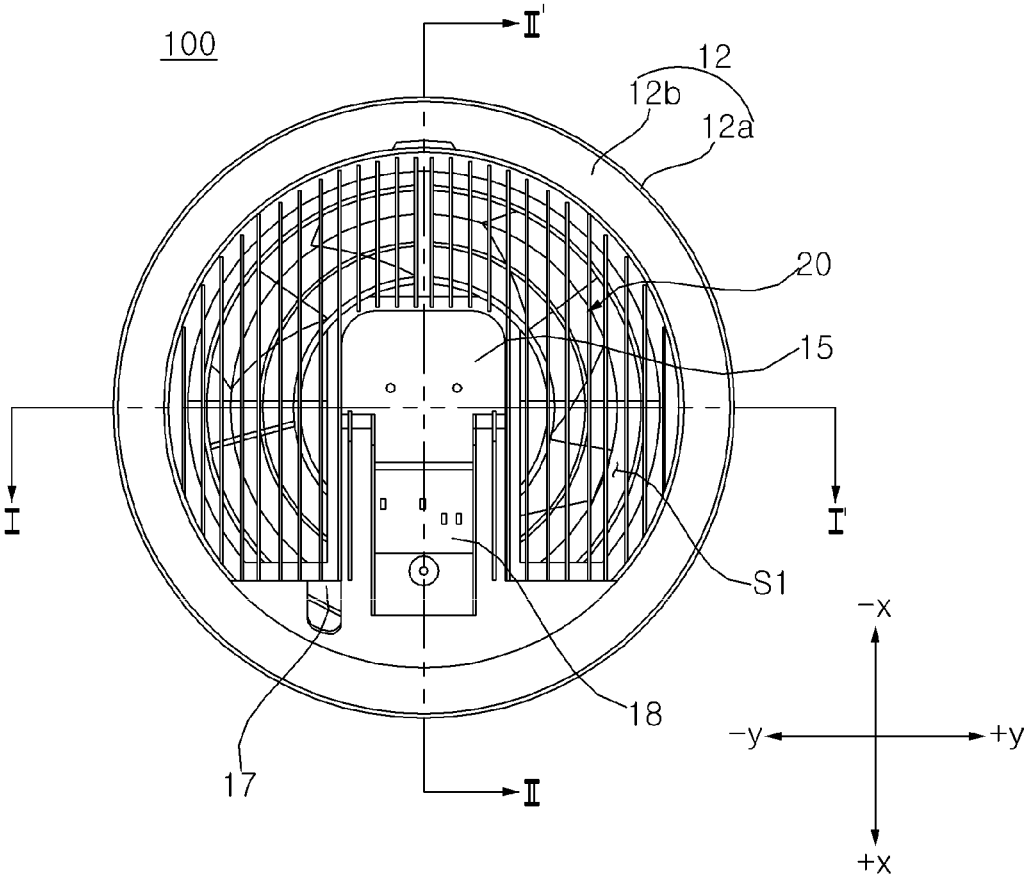
FIG. 3 is a plan view of the air circulator 100 of FIG. 1 when seen from a rear.

Referring to FIGS. 1 to 3, a housing 10 may include outer walls 11 and 12 that form an outer circumference in the circumferential direction of the air circulator 100. The housing 10 may be opened at a rear thereof to form a first inlet S1, and may be opened at a front thereof to form a first outlet S3. The housing 10 may accommodate internal components of the air circulator 100, such as the circulation fan 30 and the motor 40, and may be a basis for distinguishing the inside and outside of the air circulator 100.

A front panel 80 may be disposed on the center of the front of the housing 10 to display operation information, and the first outlet S3 may be formed between the housing 10 and the front panel 80. The first outlet S3 may be circumferentially formed between the front panel 80 and the front of the housing 10. Further, a guide vane device 70 may be installed in back of the first outlet S3, and an outer grill 20 may be disposed in the first inlet S1. They will be described below in detail.

Figure 4:
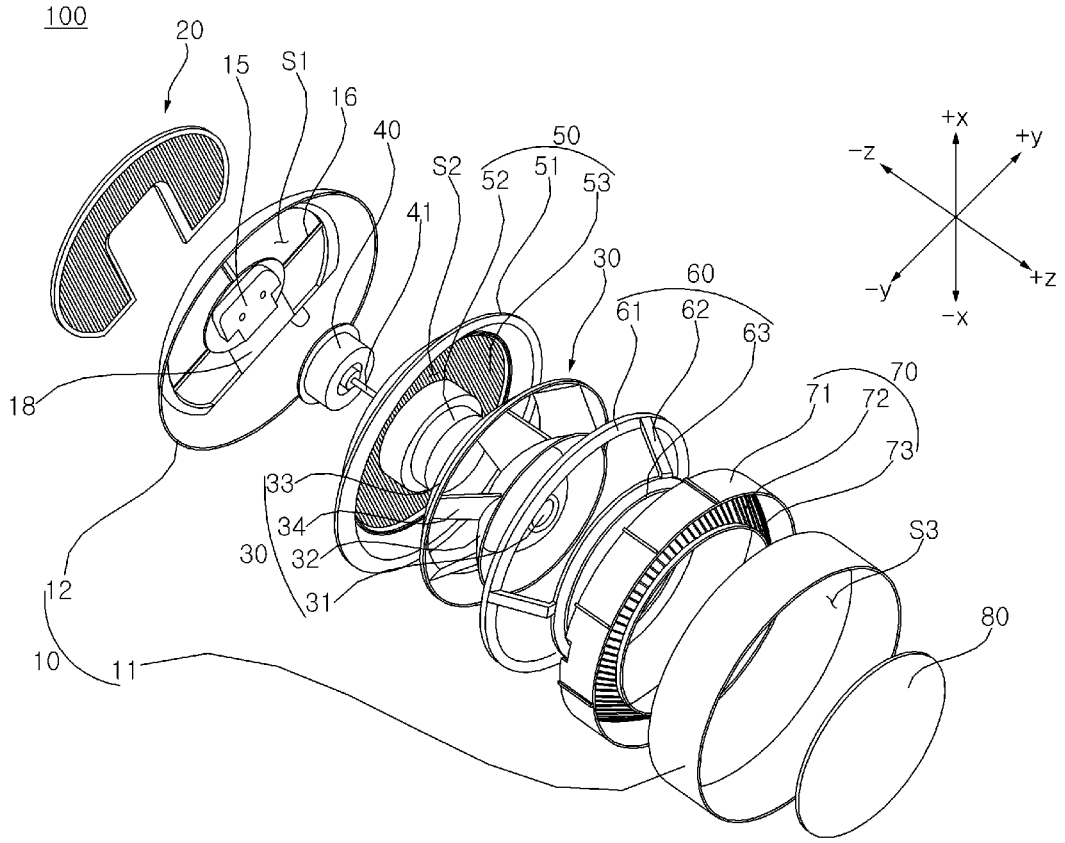
FIGS. 4 and 5 are exploded perspective views of the air circulator 100 of FIG. 1.
Figure 5:
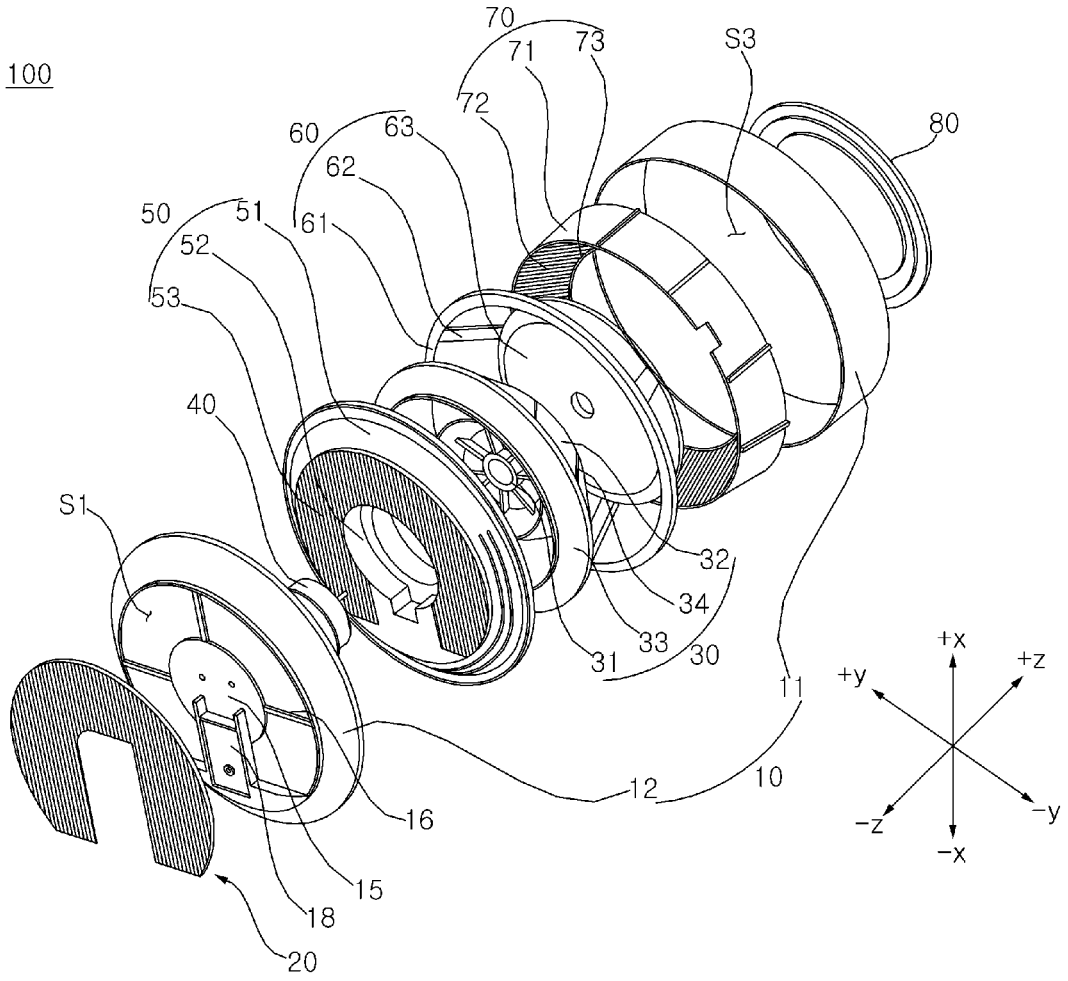
Figure 6:
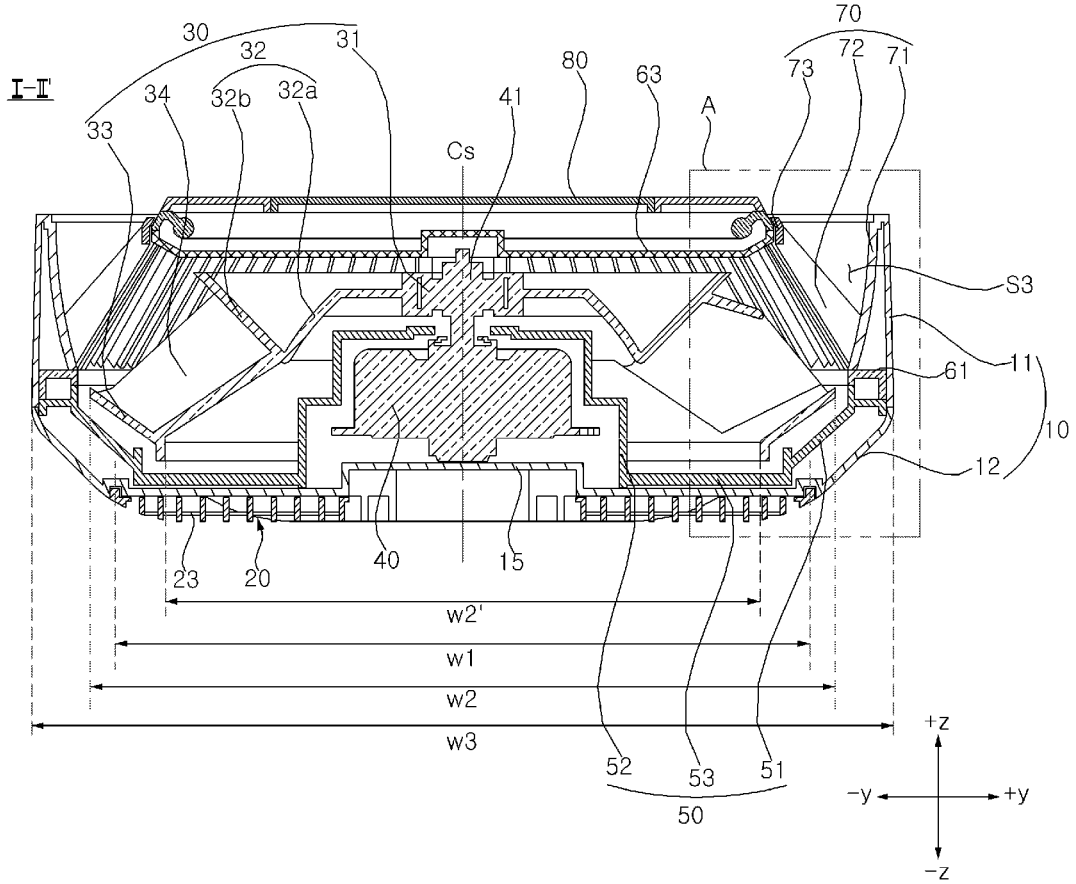
FIG. 6 is a longitudinal sectional view taken along line I-I' of FIG. 3 to show the air circulator 100 of FIG. 1.

Referring to FIGS. 4 to 6, the housing 10 may be opened in the front-rear direction to define a path where air flows from the first inlet S1 to the first outlet S3. The outer walls 11 and 12 of the housing 10 may be divided into a first outer wall 11 and a second outer wall 12 disposed in back of the first outer wall 11. The first outer wall 11 and the second outer wall 12 may be integrally formed or be coupled to each other.

The first outer wall 11 may extend in the front-rear direction. The first outer wall 11 may be opened at a front thereof to define the first outlet S3. The first outer wall 11 may circumferentially extend in the shape of a band around the central axis to have the shape of a cylinder. The first outer wall 11 may extend forwards from the second outer wall 12. The first outer wall 11 may be coupled to an outermost circumference of the second outer wall 12.

The second outer wall 12 may be opened at a rear thereof to define the first inlet S1. The second outer wall 12 may extend from an edge of the first inlet S1 towards the first outer wall 11 to be gradually enlarged radially outwards. The second outer wall 12 may extend to be inclined forwards, thus forming a circumference. In other words, the second outer wall 12 may have a shape of a bowl that is reduced in diameter in a direction from the front to the rear, and is opened at a rear thereof.

Figure 7:
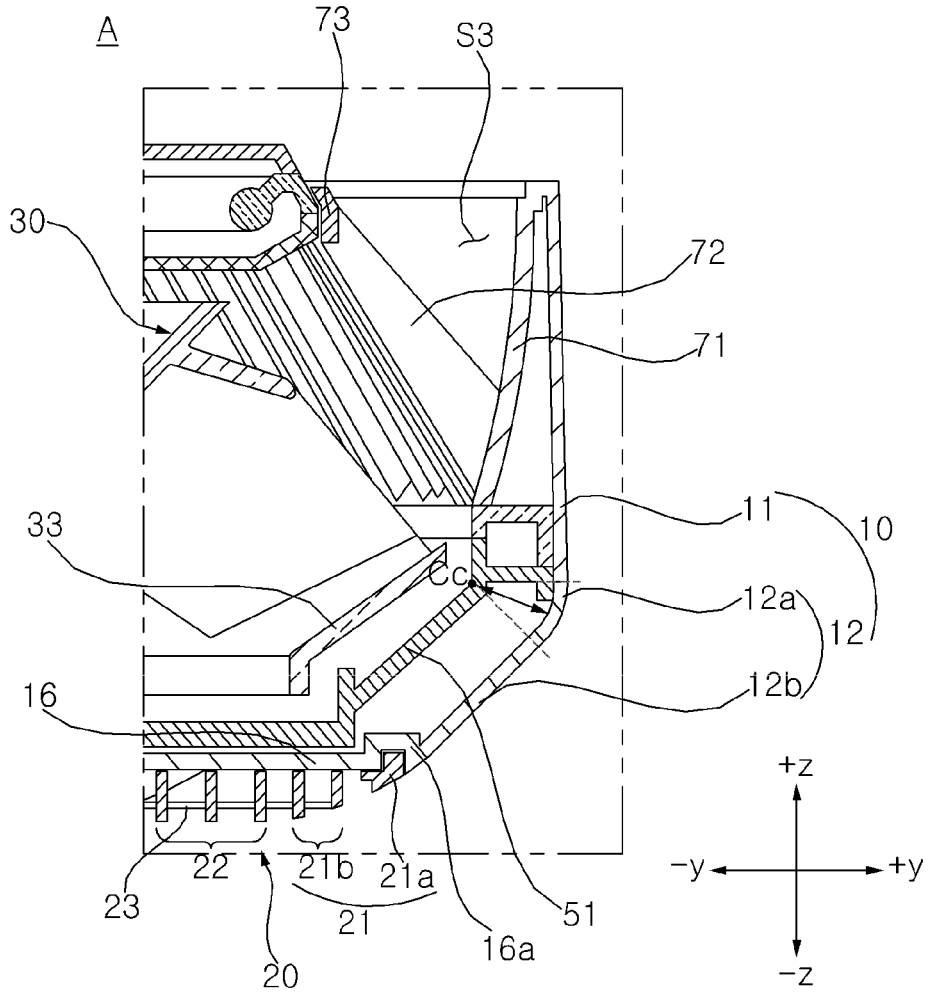
FIG. 7 is an enlarged longitudinal sectional view showing portion A of FIG. 6.
Figure 8:
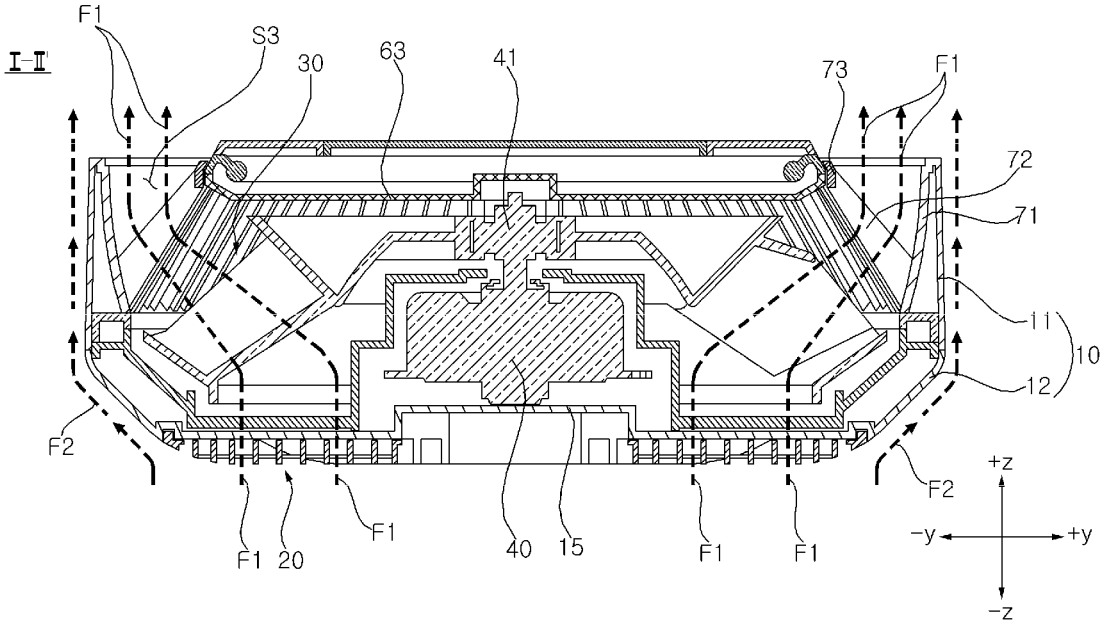
FIG. 8 illustrates the flow of air as a circulation fan 30 rotates in the air circulator 100 of FIG. 6.

Here, since the second outer wall 12 extends from the edge of the first inlet S1 towards the first outer wall 11 to be gradually enlarged radially outwards, air flowing along the outside of the first inlet S1 may be guided to flow forwards along the outer surface of the first outer wall 11 through the Coanda effect (see F2 of FIG. 8). This will be described below in detail with reference to FIGS. 6 to 8.

The outer grill 20 through which an air intake passage is formed may be disposed in the first inlet S1 formed in the second outer wall 12. A coupling groove 16*a* (see FIG. 7) may be formed in back of the second outer wall 12 to guide the placement of the outer grill 20.

The outer grill 20 may include a plurality of partition walls 21 and 22 (see FIG. 7). The outer grill 20 may form a plurality of vent holes between the partition walls 21 and 22. By way of example, the outer grill 20 is configured such that linear vent holes are continuously formed in a circular plate.

Meanwhile, a filter member 23 may be disposed in the first inlet S1 to remove dust from the air that is suctioned through the first inlet S1. In this case, the filter member 23 may be disposed between the plurality of partition walls 21 and 22 or in front of the plurality of partition walls. Here, the plurality of partition walls 21 and 22 of the outer grill 20 may serve as a frame for supporting the filter member 23.

Meanwhile, the circulation fan 30 may be disposed in the housing 10. The circulation fan 30 may be disposed in front of the outer grill 20. The circulation fan 30 may be coupled to the motor 40 that rotates the circulation fan. The circulation fan 30 may rotate to generate air flow. The circulation fan 30 may suction air through the outer grill 20 into the housing 10, and then discharge the air through the first outlet S3 to the front of the housing 10. The circulation fan 30 may use an axial-flow fan or an oblique-flow fan.

The circulation fan 30 may be the oblique-flow fan that discharges air suctioned through the first inlet S1 in a forwardly inclined direction of the housing 10. The oblique-flow fan 30 may include a shaft coupling part 31, a hub 32, a shroud 33, and a blade 34. The oblique-flow fan is advantageous in that it is possible to generate a relatively higher air volume in a limited path area, as compared to the axial-flow fan.

The shaft coupling part 31 may be positioned between a motor cover 52 and a panel base 63, which will be described below. The shaft coupling part 31 is a hollow part that is opened in the front-rear direction, and may be connected to an output shaft 41 of the motor 40 to rotate along with the output shaft.

The hub 32 may be disposed in front of the motor 40, and the shaft coupling part 31 may be formed on the center of the hub to be connected to the output shaft 41 of the motor 40. The hub 32 may be disposed in front of the motor, and may include at least any one of an inner hub 32*a* having on a center thereof the shaft coupling part 31, and an outer hub 32*b* extending obliquely from the inner hub 32*a* radially outwards.

The inner hub 32*a* may be formed to be convex towards the front, and may have in a rear thereof a space in which the motor 40 and the motor cover 52 are disposed. The inner hub 32*a* may be formed to surround a portion of the motor 40 and the motor cover 52. The inner hub 32*a* may have a shape of a bowl that is convex towards the front.

The outer hub 32*b* may extend to be inclined forwards in the radially outward direction. A front end of the blade 34 may be coupled to a rear surface of the outer hub 32*b*.

Further, the shroud 33 may be disposed in back of the hub 32 to be spaced apart therefrom, and the circular inlet S2 into which air is suctioned may be formed in the central portion of the shroud 33. The shroud 33 may be formed in a ring shape to surround at least a portion of the motor 40. Here, a diameter w2' of the inlet S2 formed in an inner circumferential end of the shroud 33 may be formed to be equal to or smaller than a diameter w1 of the first inlet S1.

The shroud 33 may be disposed in back of the hub 32 to be radially outwards spaced apart therefrom. Here, the front surface of the shroud 33 may be obliquely formed forwards to face the rear surface of the outer hub 32*b*. Therefore, the outer hub 32*b* and the shroud 33 may guide the air suctioned through the inlet S2 to cause the air to flow in a forward inclined direction.

The outer hub 32*b* and the shroud 33 may extend forwards to be gradually enlarged in the radially outward direction, and may face the second outer wall 12. In other words, when the second outer wall 12 is obliquely formed, the outer hub 32*b* and the shroud 33 may be inclined to face the second outer wall 12. Therefore, air flowing along the outer surface of the second outer wall 12 may be guided to the outer surface of the first outer wall 11, and simultaneously an area between the outer hub 32*b* and the shroud 33 may be maximized, thus maximizing a flow quantity of the air that passes between the outer hub and the shroud.

A plurality of blades 34 may be disposed between the hub 32 and the shroud 33 to connect the hub and the shroud. Each blade 34 may extend from the front surface of the shroud 33 towards the rear surface of the outer hub 32*b* to be inclined forwards. In other words, the blade 34 may extend to be inclined forwards in the axial direction corresponding to the flow direction of the air. Thus, the air flowing out through the blade 34 may flow in a forwardly inclined direction, and an area coming into contact with the blade 34 may be increased to the maximum.

Meanwhile, as the diameter w1 of the first inlet S1 is decreased, the intake path area may be reduced and the area of the second outer wall 12 may be increased. In the case of the oblique-flow fan 30, the air is suctioned from the first inlet S1 and then is discharged in a forwardly inclined direction. Thus, even if the intake path area is reduced as compared to the axial-flow fan, airflow may be circulated while a reduction in air volume is minimized.

In the case of using the oblique-flow fan 30, even if the diameter w1 of the first inlet S1 is formed to be smaller than the diameter w2 of the oblique-flow fan 30, a loss of air volume that is suctioned through the first inlet S1 into the air circulator 100 and then is discharged may be minimized, and simultaneously the area of the second outer wall 12 for inducing the Coanda effect may be secured. Therefore, the diameter w1 formed by the edge of the first inlet S1 may be equal to or larger than the diameter w2' formed by the inner circumferential end of the shroud 33, and may be smaller than the diameter w2 formed by the outer circumferential end of the shroud 33.

Meanwhile, the air circulator 100 may further include a motor base 15. The motor base 15 may be disposed in front of the outer grill 20. The motor base 15 may be disposed in the center of the rear of the second outer wall 12. The motor base 15 may be disposed to be spaced apart from the innermost circumference of the second outer wall 12.

The first inlet S1 may be formed between the motor base 15 and the second outer wall 12. Further, a support bar 16 may extend long from a side of the second outer wall 12 towards the motor base 15 in the radially inward direction. The motor base 15 may be disposed in back of the motor 40 to support the motor.

A connection plate 18 may extend from a side of the second outer wall 12 in the radially inward direction to be connected to the motor base 15. A second rack 295 of a second rotary guide mechanism may be coupled to the rear of the connection plate 18 to guide a rotation in a second direction (see FIG. 11). A wire hole 17 (see FIG. 3) may be formed in the connection plate 18 to cause an electric wire connected to the motor 340 or a display 390 to pass therethrough.

Meanwhile, the air circulator 100 may further include a motor receiving part 50. The motor receiving part 50 may include at least any one of a rear inner wall 51, a motor cover 52, and an inner grill 53.

The rear inner wall 51 may be disposed in front of the outer grill 20. The rear inner wall 51 may be opened at a front and a rear thereof, and may form a portion of an inner circumference of the air circulator 100 in a circumferential direction.

The rear inner wall 51 may extend from the rear towards the front to be gradually enlarged in the radially outward direction. The rear inner wall 51 may be obliquely formed to face the shroud 33. In other words, the rear inner wall 51 may have the shape of a bowl that is reduced in diameter in a direction from the front to the rear and is opened at a rear thereof.

Further, the rear inner wall 51 may be disposed in the second outer wall 12. The rear inner wall 51 may be configured such that an outer end of a front thereof formed in the circumferential direction is bent rearwards to be hooked to a groove (unlabelled) formed in an inner circumference of the second outer wall 12.

Further, the motor receiving part 50 may include on a rear portion thereof the inner grill 53 to define a passage through which air is suctioned. The inner grill 53 may be formed in back of the open rear inner wall 51. The motor cover 52 may be disposed on the center inside the rear inner wall 51. The inner grill 53 may be formed between the rear inner wall 51 and the motor cover 52.

The motor cover 52 may have on the front thereof a concave groove corresponding to the shape of the motor 40 to accommodate the motor 40. The motor cover 52 may be formed to surround the motor. The motor 40 may be disposed between the motor base 15 and the motor cover 52, and the motor cover 52 may be disposed between the motor 40 and the circulation fan 30. Further, a space may be defined between the rear inner wall 51 and the motor cover 52 to accommodate a portion of the circulation fan 30.

A hole may be formed in the center of the front of the motor cover 52 to allow the output shaft 41 of the motor 40 to pass therethrough. The output shaft 41 may pass through the hole formed in the front of the motor cover 52 to be coupled to the shaft coupling part 31 formed on the circulation fan 30.

Meanwhile, the air circulator 100 may further include a fan cover part 60 that is disposed in front of the circulation fan 30. The fan cover part 60 may include a corner support part 61, a bridge 62, and a panel base 63.

The corner support part 61 may be disposed in front of the rear inner wall 51. The corner support part 61 may have the shape of a ring extending in the circumferential direction. The rear inner wall 51 may have a step or a hook corresponding to the shape of the corner support part 61, so that the corner support part may be seated thereon.

Further, a panel base 63 may be disposed in front of the corner support part 61. The diameter of the panel base 63 may be smaller than that of the corner support part 61. The panel base 63 may be positioned in the center of the first outer wall 11. A front panel 80 may be mounted in front of the panel base 63. The front panel 80 and the panel base 63 may have corresponding disc shapes. A controller (not shown) may be disposed between the panel base 63 and the front panel 80 to display operation information on the front panel 80 and to control the operation of the air circulator 100 and the air cleaner 1 that will be described later. A PCB substrate may be used as the controller (not shown).

The bridge 62 may be disposed between the corner support part 61 and the panel base 63 to connect the corner support part and the panel base. The bridge 62 may have the shape of a bar that extends from an inner peripheral surface of the corner support part 61 towards the panel base 63 to be long in the radially inward direction. The bridge 62 may be obliquely formed to face the blade 34 of the circulation fan 30. A plurality of bridges 62 may be arranged in the circumferential direction of the corner support part 61.

The circulation fan 30 may be disposed inside the fan cover part 60. The panel base 63 of the fan cover part 60 may cover the fronts of the hub 32 and the shaft coupling part 31 of the circulation fan 30. A passage may be formed between a plurality of bridges 62 that are disposed between the corner support part 61 and the panel base 63 to allow air to pass therethrough.

Meanwhile, the air circulator 100 may further include a guide vane device 70 that is disposed between the first outer wall 11 and the oblique-flow fan 30 and guides air, discharged obliquely from the oblique-flow fan to the front, in the axial direction of the oblique-flow fan to discharge the air to the front of the housing. The guide vane device 70 may include a front inner wall 71, a guide vane 72, and a vane coupler 73.

The front inner wall 71 may be disposed inside the first outer wall 11, and may form a portion of the inner circumference of the air circulator 100 in the circumferential direction. The front inner wall 71 may be coupled to the corner support part 61 in front of the corner support part 61.

Further, the front inner wall 71 may extend from the corner support part 61 to the front end of the first outer wall 11 in the front-rear direction. The first outlet S3 may be formed between the front inner wall 71 and the panel base 63. The front inner wall 71 may extend from the corner support part 61 towards the front to be gradually enlarged in the radially outward direction. The front inner wall 71 may be formed to be rounded towards the front, thus minimizing the loss of flow energy and guiding the air to the first outlet S3 that is at the front position.

The vane coupler 73 may be formed in the shape of a ring extending in the circumferential direction. The vane coupler 73 may be disposed at the center on the front side of the front inner wall 71. The vane coupler 73 may be coupled to the outer circumference of the panel base 63. Further, the first outlet S3 may be formed between the vane coupler 73 and the front inner wall 71.

The guide vane 72 may be disposed between the front inner wall 71 and the vane coupler 73. A plurality of guide vanes 72 may be obliquely arranged along the outer circumference of the vane coupler 73. Plates of the guide vanes 72 curved along a curved shape may be radially installed about the vane coupler 73.

One side of the guide vane 72 may be connected to the outer peripheral surface of the vane coupler 73, while the other side of the guide vane may be connected to the inner peripheral surface of the front inner wall 71. The guide vane 72 may be installed towards the front to be inclined in the radially inward direction. The guide vane 72 may be installed to face the blade 54.

Since the guide vane 72 is obliquely installed, an air discharge area may be increased to allow a larger amount of air to be discharged to the front of the guide vane 72. Further, since the cylindrical front inner wall 71 is installed on the outside of the guide vane 72, air discharged from the guide vane 72 may linearly move forwards while coming into contact with the inner peripheral surface of the front inner wall 71. Thus, the linearity of the discharged air may be improved, and the air volume may reach a more distant position.

Referring to FIGS. 6 to 8, as described above, the outer walls 11 and 12 of the housing 10 may include a first outer wall 11 having on a front thereof the first outlet S3 and a second outer wall 12 having on a rear thereof the first inlet S1. Further, the first outer wall 11 may be disposed in front of the second outer wall 12 to extend in the front-rear direction, and the second outer wall 12 may extend from the edge of the first inlet S1 towards the first outer wall 11 to be gradually enlarged in the radially outward direction.

Meanwhile, if the circulation fan 30 is rotated by the motor 40, air (hereinafter referred to as "outside air") present outside the air circulator 100 may be suctioned through the outer grill 20 disposed in the first inlet S1. Thereafter, the suctioned air may pass through the interior of the air circulator 100 and then may be discharged through the first outlet S3 formed in the front of the first outer wall 11 to the front of the housing 10 (see F1 of FIG. 8). Here, as the circulation fan 30 rotates, some of the outside air flowing towards the outer grill 20 may leak to the outside of the air circulator 100 while having directivity without being suctioned through the outer grill 20 into the air circulator 100, thus causing a loss of flow energy.

Here, the second outer wall 12 may extend from the edge of the first inlet S1 towards the first outer wall 11 to be gradually enlarged in the radially outward direction, thus guiding air flowing along the outside of the first inlet S1 through the Coanda effect to cause the air to flow forwards along the outer surface of the first outer wall 11 (see F2 of FIG. 8).

The above-described Coanda effect refers to an effect in which, when fluid flowing in one direction comes into contact with solid, the fluid adheres to a surface of the solid instead of flowing linearly, and thus flows along the surface of the solid.

In other words, air leaking to the outside of the first inlet S1 may be guided along the outer surface of the second outer wall 12 to the outer surface of the first outer wall 11. Subsequently, the air may flow along the outer surface of the first outer wall 11 extending in the front-rear direction to a direction where the airflow of the air circulator 100 is directed (see F2 of FIG. 8). Here, the expression "predetermined airflow direction" may mean a direction in which a user desires to discharge air through the air circulator.

The first outer wall 11 and the second outer wall 12 may be integrally coupled to each other, and may form a continuous circumferential surface in the circumferential direction without having an outwardly protruding portion in the coupled portion. The outer surface of the first outer wall 11 and the outer surface of the second outer wall 12 may form a continuous surface, thus minimizing flow resistance to air that is guided along the outer surface of the second outer wall 12 to the outer surface of the first outer wall 11.

Further, the first outer wall 11 may circumferentially extend in the shape of a band around the central axis to have the shape of a cylinder. Therefore, the first outer wall 11 may guide the air flowing along the outer surface of the first outer wall 11 to a predetermined direction in which the air circulator 100 discharges the air.

Further, the outer surface of the first outer wall 11 may be formed to be parallel to the rotating axis of the circulation fan 30 in the front-rear direction. Here, the diameter w3 formed by the outer circumferential end of the first outer wall 11 may be equal to the diameter w3 formed by the outer circumferential end of the second outer wall 12. Therefore, it is advantageous in that it is possible to secure a large discharge path area of the air circulator 100 and simultaneously to increase linearity where the air flowing along the outer surface of the first outer wall 11 is directed to a predetermined direction.

Here, it is to be understood that the term "parallel" does not mean that two components should strictly form the angle of 180 degrees, and includes that two components are slightly inclined in a radial direction to be almost parallel to each other. In other words, the diameter of the front portion of the first outer wall 11 may be formed to be finely reduced from the rear to the front.

Meanwhile, the second outer wall 12 may be formed to surround at least a portion of the shroud 33 of the circulation fan 30. Further, the first outer wall 11 disposed in front of the second outer wall 12 may be formed to surround at least a portion of the hub 32 of the circulation fan 30. In other words, the circulation fan 30 may be accommodated in the housing 10, and may be disposed between the first outer wall 11 and the second outer wall 12 of the housing 10.

Meanwhile, the outer surface of the first outer wall 11 and the outer surface of the second outer wall 12 may form a continuous surface in a circumferential direction to be shielded without forming a spaced gap. Therefore, while air flowing along the outside of the first inlet S1 is guided along the outer surface of the second outer wall 12 to the outer surface of the first outer wall 11, it is possible to prevent air from flowing through the first and second outer walls 11 and 12 into the air circulator 100.

Meanwhile, the outer surface of the second outer wall 12 may include a first surface 12*a* extending to be rounded in the radially outward direction towards the first outer wall 11 disposed in front of the second outer wall. The first surface 12*a* may extend from the edge of the first inlet S1 to the first outer wall 11, or may extend from the front of a second surface 12*b*, which will be described below, to the first outer wall 11.

The first surface 12*a* may be formed to be convex to the outside of the housing 10, thus forming the center of a curvature radius in an inward direction of the housing 10. The first surface 12*a* may form the centers of a plurality of curvature radii in the front-rear direction. For example, the curvature radius formed by the curved surface of the first surface 12*a* may be gradually increased towards the front, so the curvature radius may become a maximum at a connection portion connected to the first outer wall 11.

The first surface 12*a* may be connected to the rear of the first outer wall 11. The first surface 12*a* may be formed to be rounded at the connection portion between the outer surface of the first outer wall 11 and the outer surface of the second outer wall 12.

In this case, air flowing along the outside of the first inlet S1 may flow along the curvature of the curved surface formed by the first surface 12*a* of the second outer wall 12 to minimize flow resistance, thus allowing the air to be guided to the first outer wall 11 while smoothly changing the flow in a predetermined airflow direction.

Meanwhile, the outer surface of the second outer wall 12 may include a second surface 12*b* that extends from the edge of the first inlet S1 towards the first surface 12*a* so that the slope of the longitudinal section is constant. Here, the first surface 12*a* may be disposed between the second surface 12*b* and the outer surface of the first outer wall 11. The longitudinal section of the second surface 12*b* may extend almost linearly towards the first surface 12*a*, so the second surface 12*b* may minimize a change in flow path and may guide air flowing along the outside of the first inlet S1 to the first surface 12*a*.

Meanwhile, the first outer wall 11 and the second outer wall 12 may be detachably coupled to each other. In other words, since the first outer wall 11 may be detached from the second outer wall 12, the internal components of the air circulator 100 may be easily managed. For example, after the first outer wall 11 is detached from the second outer wall 12, the guide vane device 70, the fan cover part 60, the blowing fan 30, and the motor receiving part 50 may be sequentially detached and then respective components may be cleaned or replaced.

Meanwhile, the outer grill 20 may be disposed in the first inlet S1 that is formed in the rear of the second outer wall 12. The outer grill 20 may include a plurality of partition walls 21 and 22 that are spaced apart from each other to form a plurality of vent holes therebetween. In this case, the second outer wall 12 may extend from the edge of the outer grill 20 towards the first outer wall 11 to be gradually enlarged in the radially outward direction. Therefore, the diameter w3 formed by the outer circumferential end of the second outer wall 12 and/or the diameter w3 formed by the outer circumferential end of the first outer wall 11 may be greater than the diameter w1 formed by the circumference of the outer grill 20.

The plurality of partition walls 21 and 22 may include a plurality of outer partition walls 21 disposed adjacent to the edge of the outer grill 20. The plurality of outer partition walls 21 may be formed such that ends thereof are inclined towards the outer surface of the second outer wall. Therefore, in the air flowing along the outside of the outer grill 20, air that is not suctioned through the outer grill 20 may flow along an end surface of the outer grill 20 to be guided to the second outer wall 12.

Further, the ends of the plurality of outer partition walls 21 may be rounded to form an inclined surface that is continuous with the outer surface of the second outer wall 12. Here, when an imaginary line passing through the outer surface of the second outer wall 12 and the end surface of the outer partition wall 21 extends, the imaginary line may form a continuous gentle curve. Therefore, it is possible to minimize flow resistance when the air flows along the end surface of the outer grill 20 to be guided to the second outer wall 12.

The outer partition wall 21 may include a first outer partition wall 21*a* forming the edge of the outer grill 20, and a second outer partition wall 21*b* disposed inside the first outer partition wall 21*a*. The second outer wall 12 may extend from the first outer partition wall 21*a* forming the edge of the outer grill 20 towards the first outer wall 11. Further, the outer surface formed by the end of the first outer partition wall 21*a* may be formed to be rounded, so the outer surface of the first outer partition wall 21*a* and the outer surface of the second outer wall 12 may form a continuous inclined surface.

Meanwhile, a coupling protrusion (unlabelled) may formed on a front surface of the first outer partition wall 21*a* to protrude forwards, and the outer wall 12 may be depressed in a rear thereof to have a shape corresponding to that of the coupling protrusion, thus forming a coupling groove 16*a*. Therefore, the outer grill 20 may insert the coupling protrusion formed on the first outer partition wall 21*a* into the coupling groove 16*a* to be coupled to the rear of the second outer wall 12.

Meanwhile, the plurality of partition walls 21 and 22 may include a plurality of inner partition walls 22 that are disposed inside the outer partition wall 21 such that ends thereof are positioned on a flat surface. Here, the inclined surface formed by the respective ends may become gradually gentle from the first outer partition wall 21*a* to the second outer partition wall 21*b*, so a surface formed by the ends of the plurality of inner partition walls 22 may be positioned on the flat surface. When an imaginary line passing through the outer surface of the second outer wall 12 and the end surfaces of the plurality of partition walls 21 and 22 extends, the imaginary line may form a continuous gentle curve on the outer partition wall 21, and may form a straight line on the inner partition walls 22. Therefore, it is possible to prevent the volume of the outer grill 20 from being unnecessarily increased to the rear of the air circulator 100.

[Air Cleaner 1 Including Air Circulator 100]

Figure 9:
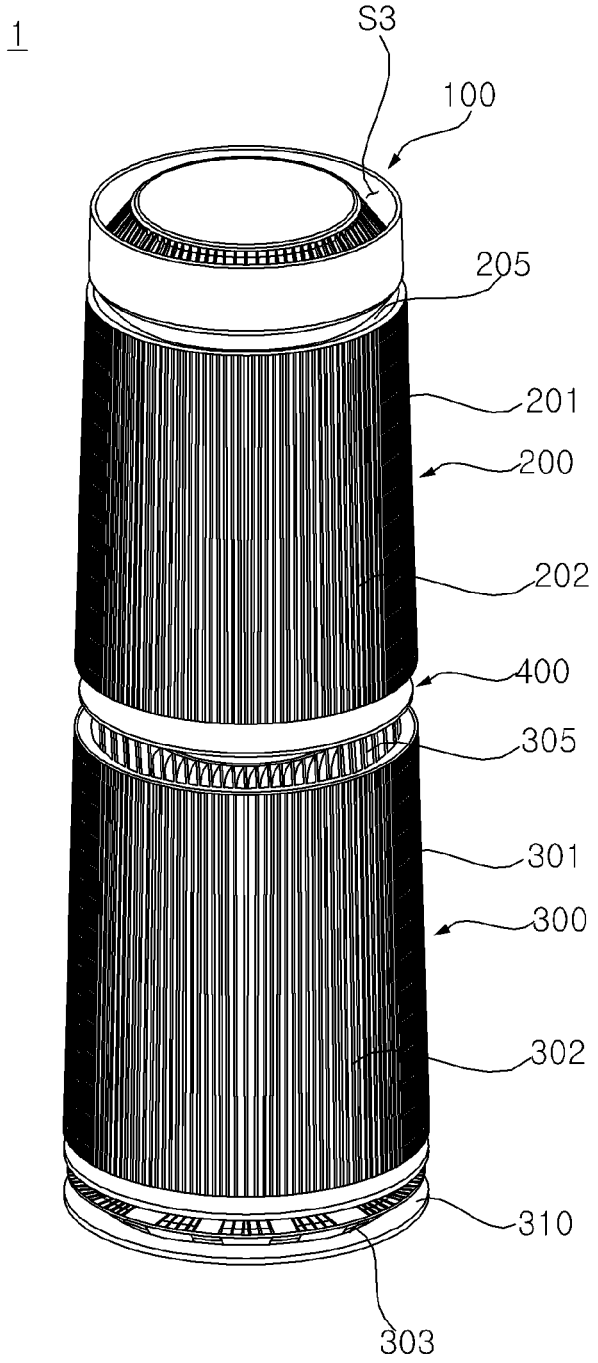
FIG. 9 is a perspective view of an air cleaner 1 including the air circulator 100 of FIG. 1.

Referring to FIG. 9, the air cleaner 1 according to an embodiment of the present disclosure may include blowing devices 200 and 300, and an air circulator 100 that changes the direction of air discharged from the blowing devices 200 and 300 to a predetermined airflow direction. The blowing devices 200 and 300 may include an upper blowing device 200 that is disposed on an upper portion of the air cleaner 1 to discharge clean air, and a lower blowing device 300 that is disposed under the upper blowing device 200 to discharge clean air.

The upper blowing device 200 may include a first case 201 that defines an appearance, and the lower blowing device 300 may include a second case 301 that defines an appearance. Each of the first case 201 and the second case 301 may be formed to have a cylindrical shape. Each of the first case 201 and the second case 301 may be formed such that the diameter of an upper portion thereof is smaller than the diameter of a lower portion thereof.

Second and third inlets 202 and 302 formed of a plurality of through holes through which outside air is suctioned may be formed on outer circumferential surfaces of the first and second cases 201 and 301, so the outside air may be introduced into the blowing devices 100 and 200 in a 360-degree direction.

A base 310 may be disposed under the lower blowing device 300 to be spaced apart from the lower blowing device 300. A fourth inlet 303 may be formed in a space between the base 310 and the lower blowing device 300 to allow outside air to be introduced into the lower blowing device 300.

A second outlet 205 may be formed in the upper portion of the upper blowing device 200 to discharge filtered clean air, and a third outlet 305 may be formed in the upper portion of the lower blowing device 300 to discharge filtered clean air. The second outlet 205 may refer to a region opened to the upper portion of an upper discharge guide 280 that will be described later, and may refer to a region opened to the upper portion of an upper discharge grill 285 when the upper discharge grill 285 is disposed inside the upper discharge guide 280. The second outlet 205 may be formed between the air circulator 100 disposed on the top of the upper blowing device 200 and the upper discharge grill 285.

The air circulator 100 may be movably disposed on a side of the upper blowing device 200 to change the direction of air discharged through the second outlet 205 and then discharge the air to an outside. By way of example, the air circulator 100 may be disposed above the second outlet 205 formed in the upper portion of the upper blowing device 200 to be spaced apart therefrom, and may change the direction of air discharged from the second outlet 205 to a predetermined airflow direction.

Meanwhile, an air direction regulator 400 may be disposed between the upper blowing device 200 and the lower blowing device 300 to be spaced apart from the third outlet 305 of the lower blowing device 300, thus discharging the air in the radially outward direction while limiting the upward flow of the air discharged through the third outlet 305. The expression "limiting the upward flow" may mean that air discharged through the third outlet 305 of the lower blowing device 300 to the outside is prevented from being directly introduced into the upper blowing device 200 without flowing towards an external space.

Figure 10:
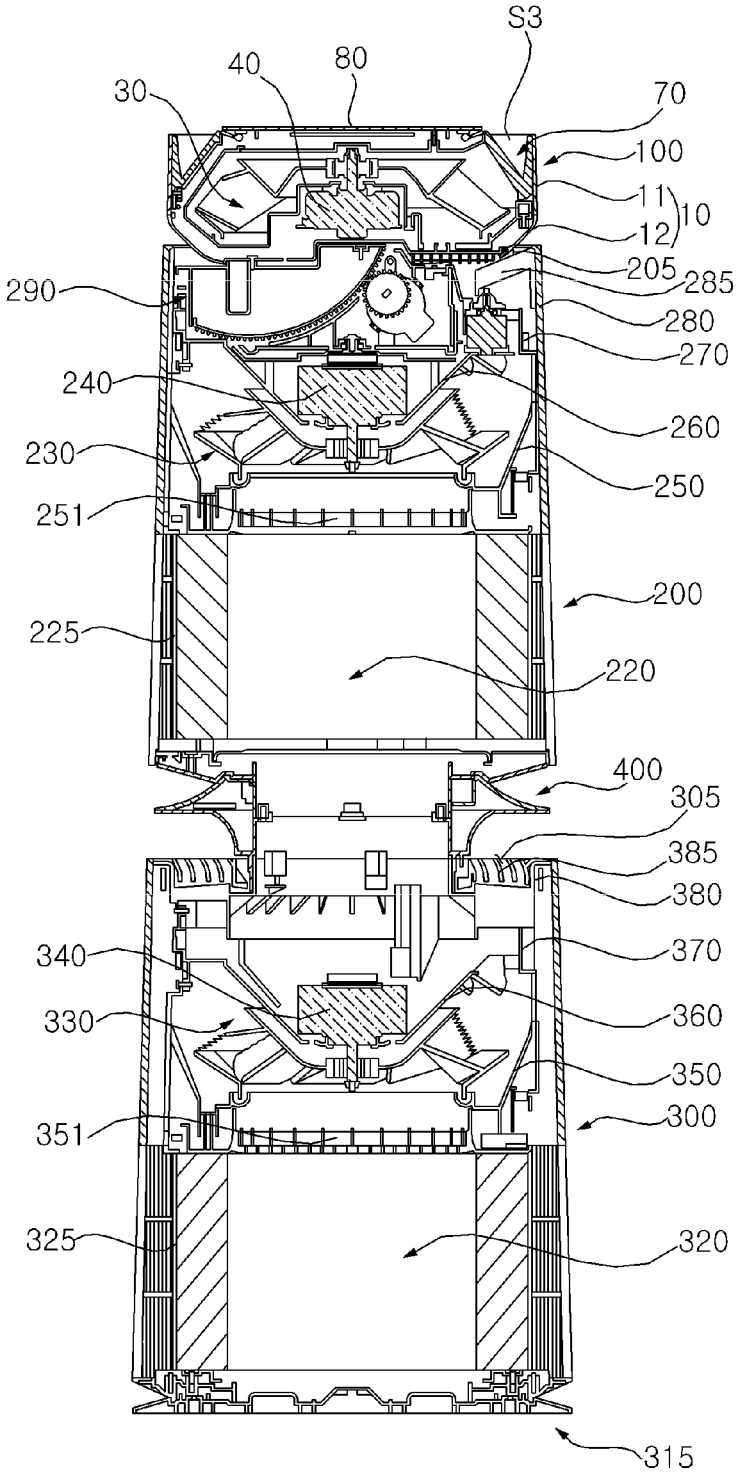
FIG. 10 is a longitudinal sectional view of the air cleaner 1 of FIG. 9.

Referring to FIG. 10, a first filter 220 may be disposed in the upper blowing device 200 to correspond to the second inlet 202 shown in FIG. 1, and the first filter 220 may be formed in a cylindrical shape.

The first filter 220 may be fixed/supported by a first filter support 225 and a first filter cover (unlabelled) coupled to the outside of the first filter support. A sensor device (unlabelled) including a dust sensor that measures the amount of dust contained in the introduced air and a gas sensor may be disposed on the upper portion of the first filter 220.

An exit may be formed in the center on the top of the first filter 220 to discharge the introduced air, and a first fan housing 250 accommodating a first blowing fan 230 may be disposed on an exit side of the first filter 220.

An upper air guide 270 may be disposed above the first fan housing 250 to guide the flow of air blown by the first blowing fan 230. Further, an upper discharge guide 280 may be disposed above the upper air guide 270 to guide the air passing through the upper air guide 270 to the upper discharge grill 285.

The second outlet 205 may be formed along the circumference of the upper discharge grill 285. As the second outlet 205 is circumferentially formed on the upper surface of the upper discharge grill 285 to be spaced apart therefrom, a plurality of second outlets 205 may be annularly disposed on the upper surface of the upper discharge grill 285.

The lower blowing device 300 may be similar in structure and function to the upper blowing device 200.

The above expression "the lower blowing device is similar in structure and function to the upper blowing device 200" may mean that components forming the lower blowing device 300 may correspond to components forming the upper blowing device 200, respectively, and these components may perform the same or similar function.

In other words, the second filter 320 of the lower blowing device 300 may correspond to the first filter 220, the second fan housing 350 may correspond to the first fan housing 250, the lower air guide 370 may correspond to the upper air guide 270, the lower discharge guide 380 may correspond to the upper discharge guide 280, and the lower discharge grill 385 may correspond to the upper discharge grill 285, respectively.

The air direction regulator 400, which is a partitioning device for separating the lower blowing device 300 from the upper blowing device 200, may be disposed above the lower discharge grill 385.

Meanwhile, air introduced through the second inlet 202 (see FIG. 9) formed in the first case 201 into the upper blowing device 200 may pass through the first filter 220, and the air passing through the first filter 220 may flow upwards to be introduced through a first fan inlet part 251 into the first blowing fan 230. The introduced air may be blown upwards by the first blowing fan 230 that is rotatably connected to the first fan motor 240, and may flow upwards by sequentially passing through the first fan housing 250, the upper air guide 270, the upper discharge guide 280, and the second outlet 205.

The air circulator 100 may be installed above the second outlet 205, and air discharged from the upper discharge guide 280 may be discharged through the air circulator 100 to the outside. As described above, the circulation fan 30 and the motor 40 may be provided in the air circulator 100 so that air passing through the upper air guide 270 may sequentially pass through the upper discharge guide 280 and the second outlet 305 and then may be smoothly discharged to the outside.

Here, some of the air discharged from the second outlet 205 may be introduced through the first inlet S1 (see FIG. 4) into the air circulator 100 to be discharged to the front of the first outlet S3.

However, some of the air discharged from the second outlet 205 may flow along the outside of the first inlet S1 without being introduced into the first inlet S1. Here, the second outer wall 12 may guide air that is discharged from the second outlet 205 and flows along the outside of the first inlet S1 so that the air flows along the outer surface of the first outer wall 11 to the front of the air circulator 100 (see FIGS. 12 and 13). Therefore, the first outer wall 11 and the second outer wall 12 of the air circulator 100 may prevent a problem where air discharged from the upper blowing device 200 leaks to the outside of the first inlet S1 and thus air volume is reduced, and may maximize the amount of clean air flowing in a predetermined direction.

Meanwhile, the diameter w1 of the first inlet S1 formed in the rear portion of the air circulator 100 may be smaller than the diameter w4 of the second outlet 205. Here, the second outer wall 12 extending from the first inlet S1 towards the first outer wall 11 to be gradually enlarged in the radially outward direction may face at least a portion of the second outlet 205. Therefore, some of clean air discharged from the second outlet 205 may be suctioned through the first inlet S1 into the air circulator to be discharged, and clean air flowing along the outside of the first inlet without being suctioned into the first inlet may be guided along the outer surface of the second outer wall 12 to the outer surface of the first outer wall 11 to be discharged in a predetermined direction.

The second outlet 205 may be circumferentially formed on the upper surface of the upper blowing device 200, and the air circulator 100 may be disposed above the second outlet 205 that is circumferentially formed. Here, since the second outer wall 12 extending in the radially outward direction and the second outlet 205 may face in the circumferential direction, air discharged upwards from the second outlet 205 may be guided in a predetermined airflow direction while coming into contact with all sides of the second outer wall 12 in the circumferential direction.

Meanwhile, in order to adjust the flow direction of air discharged to the front of the air circulator 100, the air circulator 100 may be movably installed above the upper blowing device 200. Here, the rotary guide device 290 may be installed on the upper portion of the upper blowing device 200 to guide the motion of the air circulator 100, and may be coupled to the rear portion of the air circulator 100. The air circulator 100 may be rotated in a certain direction by the rotary guide device 290 to change the flow direction of air discharged upwards through the second outlet 205.

Meanwhile, air introduced through the third inlet 302 formed in the second case 301 into the lower blowing device 300 may pass through the second filter 320, and air passing through the second filter 320 may flow upwards to be introduced through the second fan inlet part 351 into the second blowing fan 330. Here, the introduced air may be blown upwards by the second blowing fan 330 that is rotatably connected to the second fan motor 340, and may flow upwards by sequentially passing through the second fan housing 350, the lower air guide 370, the lower discharge guide 380, the lower discharge grill 385, and the third outlet 305.

The air blown upwards by the second blowing fan 330 may be discharged through the lower discharge grill 385 to the outside of the lower blowing device 300, and may flows in the radially outward direction of the air cleaner 1 while an upward flow being limited by the air direction regulator 400.

In the above-described embodiment, the lower blowing device 300 may be omitted. In this case, the upper blowing device 200 may be referred to as a blowing device.

Figure 11:
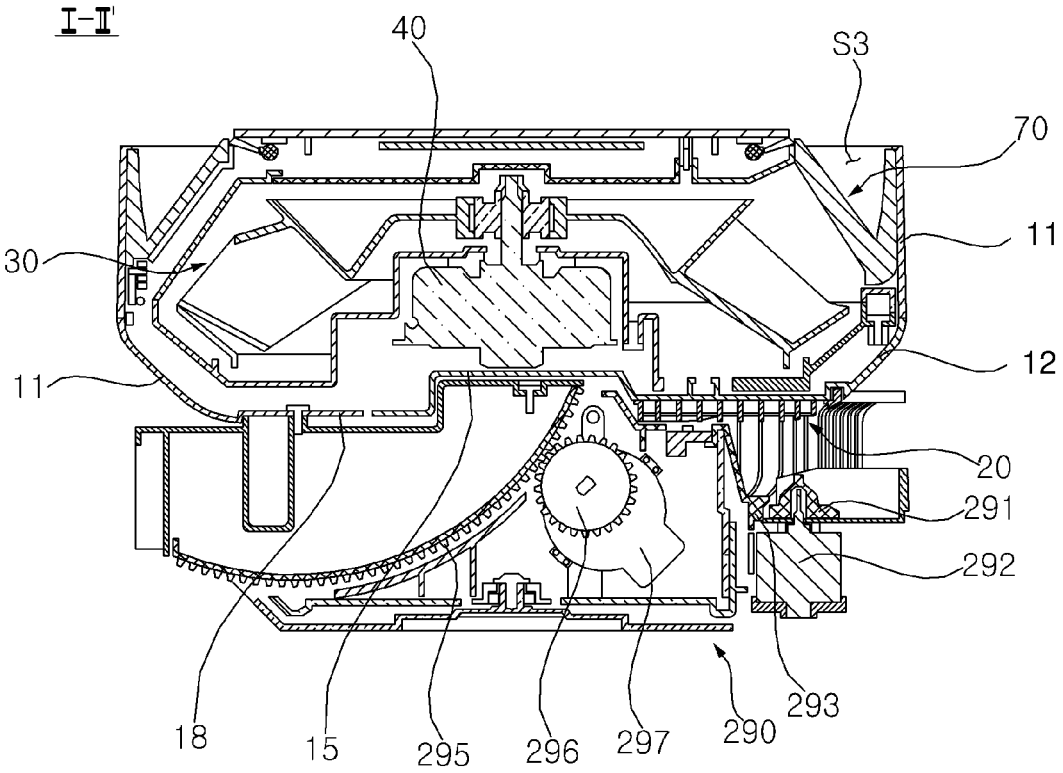
FIG. 11 is a longitudinal sectional view showing the air circulator 100 and a rotary guide device 290 disposed in an upper portion of the blowing device 200 in the air cleaner 1 of FIG. 10. The longitudinal sectional view is taken along line II-II' in the air circulator 100 of FIG. 3.

Referring to FIG. 11, the air circulator 100 may further include the rotary guide device 290 that guides the horizontal rotation and vertical rotation of the air circulator 100. The horizontal rotation may be referred to as a "first-direction rotation", and the vertical rotation may be referred to as a "second-direction rotation".

The rotary guide device 290 may include a first rotary guide mechanism to guide the first-direction rotation of the air circulator 100, and a second rotary guide mechanism to guide the second-direction rotation of the air circulator 100.

The first rotary guide mechanism may include a first rack 293 that guides the first-direction rotation of the air circulator 100. Further, the first rotary guide mechanism may include a first gear motor 292 that generates a driving force, and a first gear 291 that is rotatably coupled to the first gear motor 292. By way of example, a step motor may be included in the first gear motor 292 to easily control a rotating angle.

If the first gear motor 292 is driven, the first gear 291 may be interlocked with the first rack 293 to cause the rotary guide device 290 to be rotated horizontally. Therefore, the air circulator 100 may perform the first-direction rotation as the first rotary guide mechanism moves.

A second rack 295 may be included in the second rotary guide mechanism to guide the second-direction rotation of the air circulator 100. Furthermore, a second gear motor 297 for generating the driving force and a second gear 296 coupled to the second gear motor 297 may be included in the second rotary guide mechanism. By way of example, a step motor may be included in the second gear motor 297.

If the second gear motor 297 is driven, the second gear 296 may be interlocked with the second rack 295 to cause the rotary guide device 290 to be rotated vertically. Therefore, the air circulator 100 may perform the second-direction rotation as the second rotary guide mechanism moves.

If the air circulator 100 rotates in the second direction, it may be at a position protruding from the upper surface of the air cleaner 1. In this case, as shown in FIG. 13, a position where the air circulator 100 is obliquely erected so that the front of the air circulator 100 faces a predetermined airflow direction may be referred to as a "second position (oblique position)". On the other hand, as shown in FIG. 12, a position where the air circulator 100 lies down such that the front of the air circulator 100 faces upwards may be referred to as a "first position".

Figure 12:
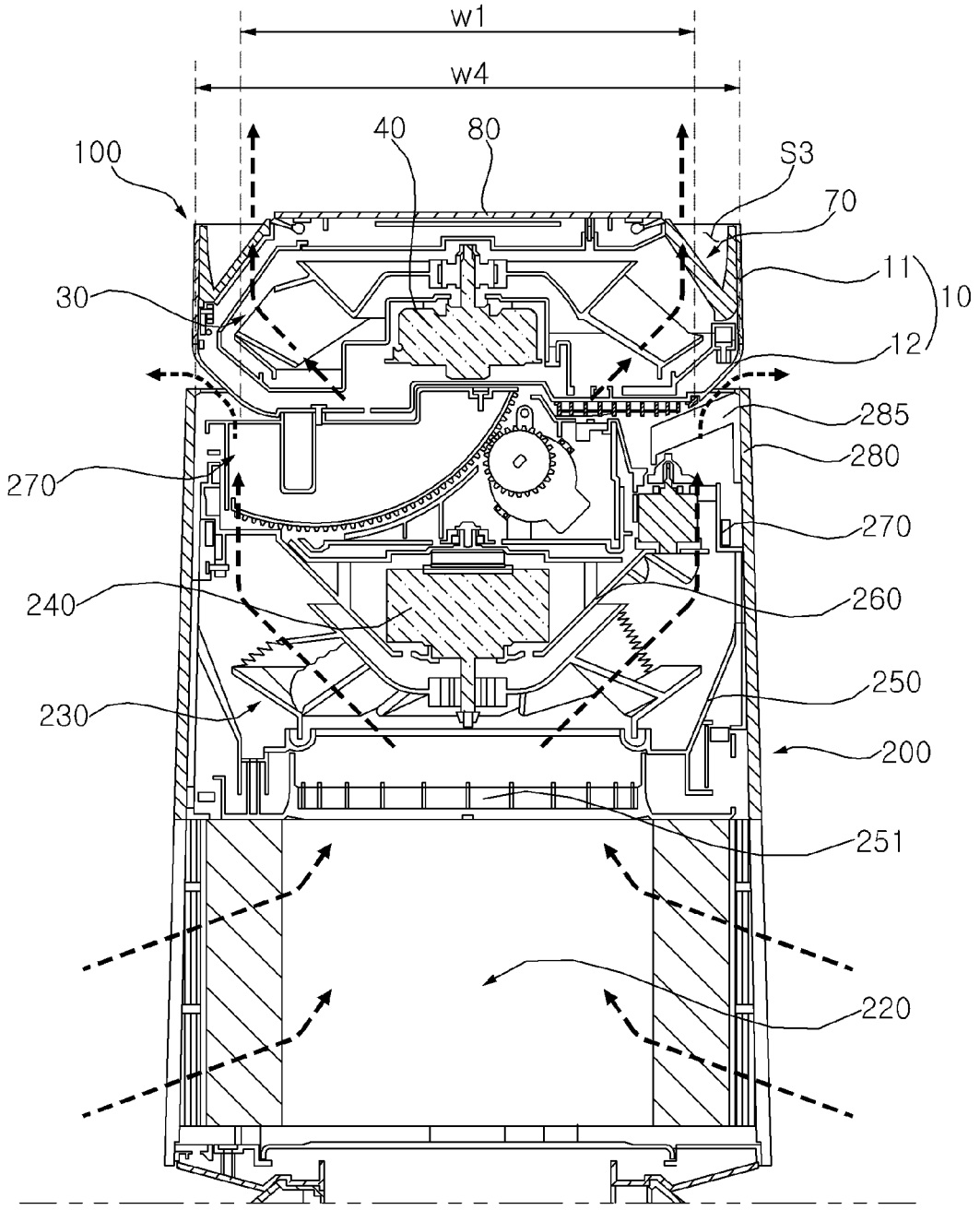
FIG. 12 is a longitudinal sectional view showing the flow of air when the air circulator 100 of the air cleaner 1 of FIG. 9 is at a first position.
Figure 13:
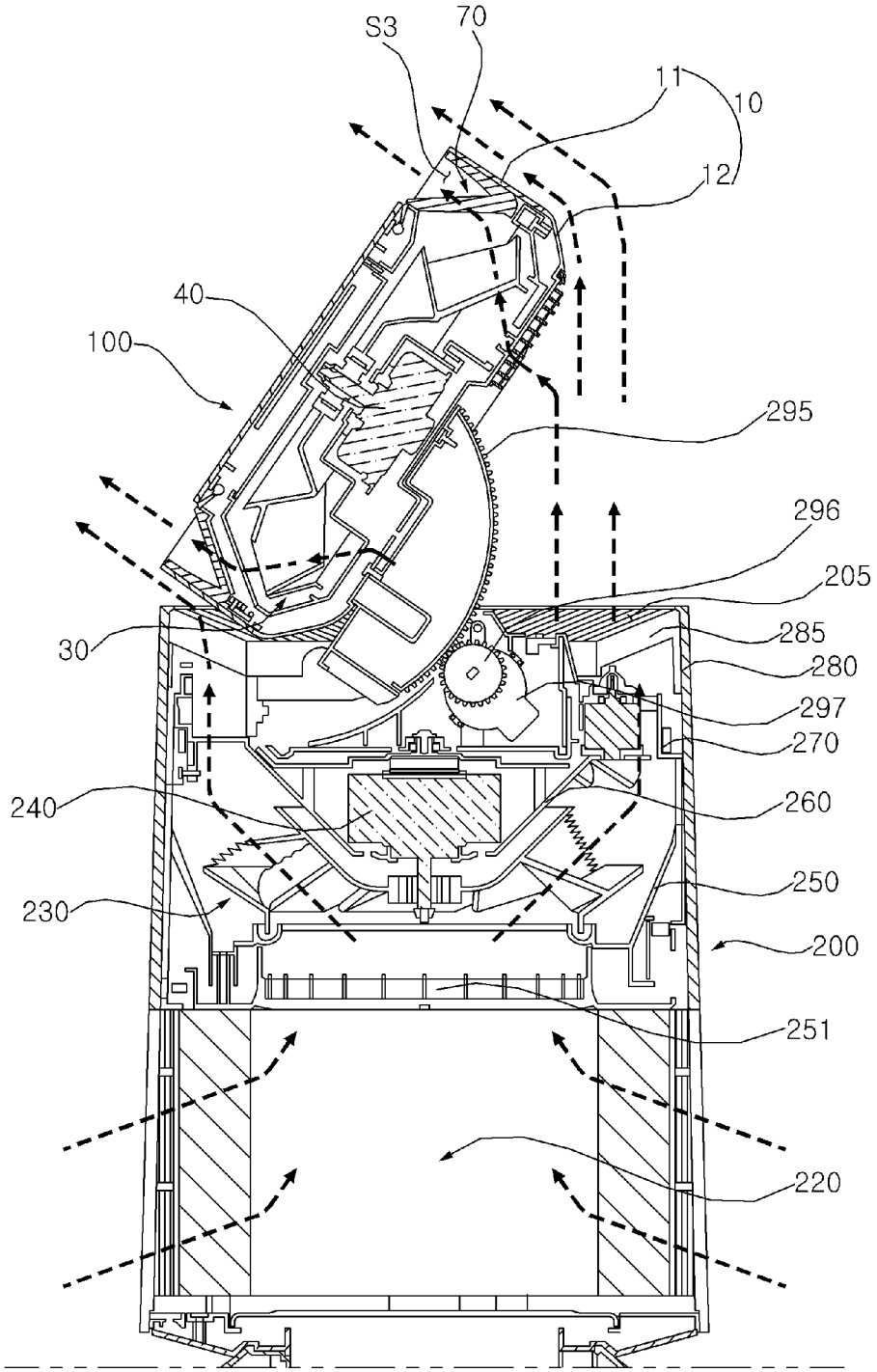
FIG. 13 is a longitudinal sectional view showing the flow of air when the air circulator 100 of the air cleaner 1 of FIG. 9 is at a second position.

Referring to FIGS. 12 and 13, as described above, air introduced through the second inlet 202 into the upper blowing device 200 may pass through the first filter 220 and flow upwards, and may be introduced through the first fan inlet part 251 into the first blowing fan 230. Here, the introduced air may be blown upwards by the first blowing fan 230, and may pass sequentially through the first fan housing 250, the upper air guide 270, and the upper discharge guide 280 to be discharged to the upper side of the second outlet 205.

Meanwhile, as shown in FIG. 12, if the air circulator 100 is positioned at the first position where it lies down above the upper blowing device 200, the first outer wall 11 of the air circulator 100 is disposed to extend long in a direction where the air is discharged from the second outlet 205, and the second outer wall 12 may be disposed above the second outlet 205 to be spaced apart therefrom and be disposed to obliquely face the second outlet 205. Here, the second outer wall 12 may be disposed in the air discharge direction of the second outlet 205 to be inclined in the radially outward direction.

Here, some of clean air discharged from the second outlet 205 may be introduced through the first inlet S1 (see FIG. 4) into the air circulator 100 to be blown upwards by the circulation fan 30, and may pass sequentially through the motor receiving part 50 and the guide vane device 70 to be discharged upwards from the first outlet S3.

Further, some of clean air discharged from the second outlet 205 may flow towards the second outer wall 12, and may be discharged along the inclined surface formed by the second outer wall 12 in the radially outward direction of the air circulator 100. Therefore, when the air circulator 100 is positioned at the first position, the air circulator 100 can uniformly discharge clean air discharged in one direction by the upper blowing device 200 in a 360-degree direction.

Meanwhile, as shown in FIG. 13, if the air circulator 100 is positioned at the second position where it is erected, the first outer wall 11 may be disposed to extend long in a predetermined airflow direction, and at least a portion of the second outer wall 12 may be disposed towards the first outer wall to be gradually enlarged in a direction where the second outlet discharges air.

Here, some of clean air discharged from the second outlet 205 may be introduced through the first inlet S1 (see FIG. 4) into the air circulator 100 to be blown by the circulation fan 30 in a predetermined airflow direction, and may pass sequentially through the motor receiving part 50 and the guide vane device 70 to be discharged to the front of the first outlet S3.

Furthermore, some of clean air discharged from the second outlet 205 may flow towards the second outer wall 12, and may be guided along the inclined surface formed by the second outer wall 12 to the outer surface of the first outer wall 11 and then be discharged towards the front of the air circulator 100. Therefore, when the air circulator 100 is positioned at the second position, the air circulator 100 can minimize a loss of flow energy due to the leakage of the clean air, discharged from the upper blowing device 200, to the outside of the air circulator 100 and a reduction in air volume discharged in a predetermined airflow direction.

Figure 14A:
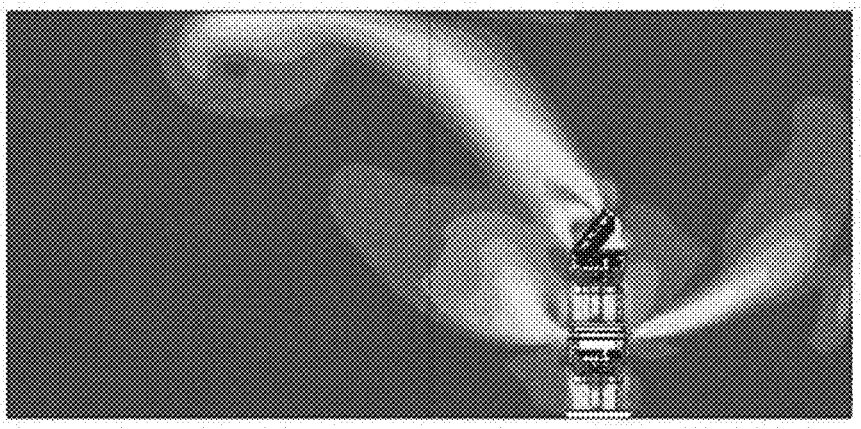
Figure 14B:
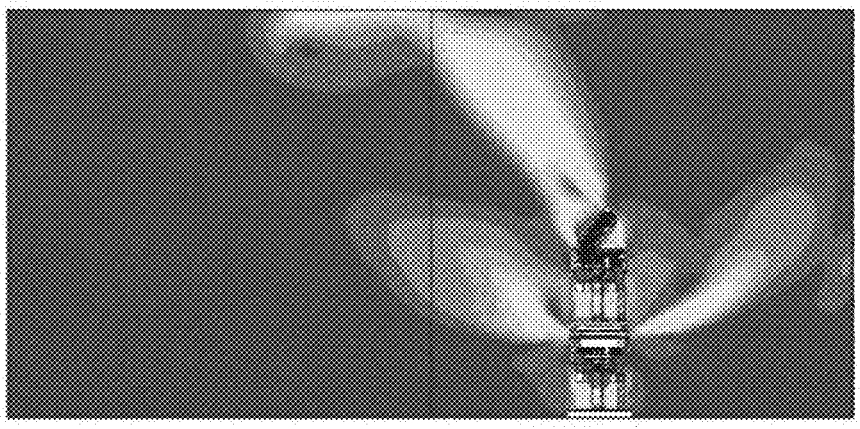
Figure 14B:
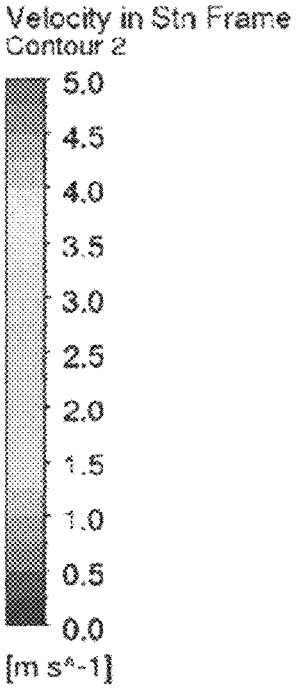

Referring to FIGS. 14A to 16B, FIGS. 14B, 15B, and 16B show an air cleaner (hereinafter referred to as "A") including the air circulator 100 according to an embodiment of the present disclosure, and FIGS. 14A, 15A, and 16A show an air cleaner (hereinafter referred to as "B") including an air circulator (unlabeled) according to another embodiment. In the case of FIGS. 14A, 15A, and 16A, the second outer wall 12 of the air circulator according to an embodiment of the present disclosure is not included, and an intake grill (unlabeled) having a plurality of vent holes is located at a position corresponding to the second outer wall 12.

Referring to the result of analyzing the air flow of A and B for each angle of the air circulator, in B, air discharged from the upper blowing device 200 is guided along the outer wall of the air circulator in a predetermined direction. Thus, the flow velocity and air volume of airflow flowing in the predetermined direction are increased as compared to those of A.

In particular, as a degree to which the air circulator is erected from the second outlet of the upper blowing device 200 increases (from FIGS. 14A to 16B), A shows that the air volume leaking to the outside of the air circulator is significantly increased, whereas B shows that the air volume leaking to the outside is markedly reduced as compared to A.

In the result of the flow analysis, when measuring the air volume discharged in a predetermined airflow direction, A is 9.6 CMM on average, and B is 10 CMM on average. Thus, it is confirmed that B has an increased air volume of the airflow having the directivity by about 6%.

Although the present invention was described with reference to specific embodiments shown in the drawings, it is apparent to those skilled in the art that the present invention may be changed and modified in various ways without departing from the scope of the present invention, which is described in the following claims.

DETAILED DESCRIPTION OF MAIN ELEMENTS

| | |
|---|---|
| 1: air cleaner | 100: air circulator |
| 10: housing | 11: first outer wall |
| 12: second outer wall | 12a: first surface |
| 12b: second surface | 20: outer grill |
| 21: outer partition wall | 22: inner partition wall |
| 30: circulation fan | 40: motor |
| 50: motor receiving part | 60: fan cover part |
| 70: guide vane device | 80: front panel |
| S1: first inlet | S3: first outlet |
| 200: upper blowing device, blowing device | 205: second outlet |

What is claimed is:

1. An air cleaner comprising:

a blowing device comprising (i) a blowing fan configured to rotate about a first vertical rotational axis and configured to discharge air upward and (ii) a first outlet defined at an upper side of the blowing device; and an air circulator disposed above the first outlet and configured to move relative to the blowing device to thereby change a flow direction of the air discharged from the first outlet, wherein the air circulator comprises:

a housing comprising an inlet, a second outlet, and an outer wall, the outer wall defining a circumferential surface of the housing disposed between the inlet and the second outlet, a circulation fan disposed in the housing and configured to rotate about a second rotational axis and to suction the air through the inlet and then discharge the suctioned air through the second outlet, and a motor configured to rotate the circulation fan, wherein the outer wall of the housing comprises:

a first outer wall extending in a direction parallel to the second rotational axis, the first outer wall having an upper end that defines an outermost boundary of the second outlet, and a second outer wall that is an annular wall extending downward from a lower end of the first outer wall in an oblique direction with respect to the second rotational axis such that the annular wall becomes closer to the second rotational axis as the annular wall extends downward, wherein the annular wall has (i) an upper end connected to the lower end of the first outer wall and (ii) a lower end defining an outermost boundary of the inlet, and wherein, in a state in which the second rotational axis of the circulation fan is disposed coaxial with the first vertical rotational axis of the blowing fan, a radial distance between the outermost boundary of the inlet and the first vertical rotational axis is shorter than a radial distance between an outermost boundary of the first outlet and the first vertical rotational axis, and wherein the second outer wall is configured to cover a part of the first outlet in the state in which the second rotational axis of the circulation fan is disposed coaxial with the first vertical rotational axis of the blowing fan.

2. The air cleaner of claim 1, wherein an outer surface of the first outer wall and an outer surface of the second outer wall define a continuous surface.

3. The air cleaner of claim 2, wherein the outer surface of the second outer wall comprises a first surface that is rounded at a connecting portion between the first outer wall and the second outer wall.

4. The air cleaner of claim 2, wherein the outer surface of the second outer wall comprises an inclined surface that has a uniform slope.

5. The air cleaner of claim 1, wherein the first outer wall and the second outer wall are detachably coupled to each other.

6. The air cleaner of claim 1, wherein the air circulator further comprises:

a motor base that is connected to a lower side of the second outer wall, that is disposed at the inlet, and that supports the motor.

7. The air cleaner of claim 6, wherein the air circulator further comprises an outer grille disposed at the inlet of the housing and detachably coupled to the second outer wall, wherein the outer grille comprises a plurality of partition walls that define a plurality of vent holes therebetween, the plurality of partition walls comprising an outer partition wall that defines an edge of the outer grille and that is coupled to the second outer wall, and wherein an end of the outer partition wall is rounded and defines a continuous inclined surface with an outer surface of the second outer wall.

8. The air cleaner of claim 7, wherein the plurality of partition walls comprises a plurality of inner partition walls that define one flat plane.

9. The air cleaner of claim 6, wherein the air circulator further comprises a motor receiving part disposed at the motor base and supporting the motor, and wherein the motor receiving part comprises:

a rear inner wall disposed inside the second outer wall and extending in a circumferential direction, a motor cover disposed opposite to the motor base with respect to the motor and surrounding the motor, and an inner grille disposed between the rear inner wall and the motor cover and defining an air passage.

10. The air cleaner of claim 9, wherein the rear inner wall expands in a radial outward direction along the second outer wall from the inlet to the second outlet.

11. The air cleaner of claim 1, wherein the circulation fan comprises:

a hub connected to an output shaft of the motor;

a plurality of blades connected to the hub; and a shroud that connects ends of the plurality of blades, the shroud defining a shroud inlet configured to receive air from the blowing device, and wherein the plurality of blades extend from the hub to the shroud and are inclined with respect to the second rotational axis of the circulation fan.

12. The air cleaner of claim 11, wherein the shroud is inclined with respect to the second rotational axis of the circulation fan to face the second outer wall.

13. The air cleaner of claim 11, wherein the hub comprises:

an inner hub comprising a shaft coupling part that is coupled to the output shaft of the motor; and an outer hub that extends from the inner hub and that is connected to the plurality of blades, wherein the outer hub is inclined with respect to the second rotational axis of the circulation fan to face the second outer wall, and wherein the outer hub and the shroud define an area therebetween configured to discharge air.

14. The air cleaner of claim 13, wherein the air circulator further comprises:

a guide vane device disposed between the first outer wall and the circulation fan and configured to guide air discharged from the circulation fan to the second outlet.

15. The air cleaner of claim 14, wherein the guide vane device comprises:

a front inner wall disposed inside the first outer wall and extending toward the second outlet along the second rotational axis of the circulation fan, and a plurality of guide vanes disposed between the plurality of blades and the front inner wall and connected to the front inner wall.

16. The air cleaner of claim 15, wherein the air circulator further comprises a corner support part that is disposed inside the outer wall of the air circulator and that supports the front inner wall, the corner support part having a ring shape extending in a circumferential direction, and wherein the front inner wall expands in a radial outward direction from the corner support part to the second outlet defined by the first outer wall.

17. The air cleaner of claim 11, wherein a diameter of the inlet of the housing is larger than a diameter of the shroud inlet.

18. The air cleaner of claim 1, further comprising:

a rotary guide device disposed between the blowing device and the air circulator and configured to rotate the air circulator to thereby rotate the circulation fan.

19. The air cleaner of claim 1, wherein a diameter of the inlet of the housing is smaller than a diameter of the first outlet.

20. The air cleaner of claim 1, wherein the first outer wall of the housing has a cylindrical shape extending along the second rotational axis of the circulation fan, and wherein a diameter of the inlet is smaller than a diameter of the cylindrical shape of the first outer wall.

21. The air cleaner of claim 1, wherein the air circulator is configured to branch the air received from the first outlet into:

a first flow entering into the inlet of the air circulator; and a second flow flowing along an outer surface of the second outer wall.

22. The air cleaner of claim 21, wherein the air circulator is configured to move to an oblique position in which the first outer wall is inclined with respect to the first vertical rotational axis of the blowing fan.

23. The air cleaner of claim 21, wherein the air circulator is configured to move to a position in which the second rotational axis of the circulation fan is coaxial with the first vertical rotational axis of the blowing fan, and wherein the air cleaner is configured to discharge the second flow in a radially outward direction of the first outlet.

24. The air cleaner of claim 1, wherein the outermost boundary of the inlet is disposed inside an edge of the second outlet in a diametrical direction of the second outlet.

25. The air cleaner of claim 24, wherein a diameter of the outermost boundary of the inlet is less than a diameter defined by the upper end of the first outer wall, the upper end of the first outer wall defining the second outlet.

26. The air cleaner of claim 1, wherein the inlet defines a flat surface that is perpendicular to the second rotational axis.

* * * * *